US005366212A

United States Patent [19]

Crowley et al.

[11] Patent Number: 5,366,212

[45] Date of Patent: Nov. 22, 1994

[54] WEB-FED SHEET STACKER AND SEPARATOR

[75] Inventors: H. W. Crowley, Newton; John W. Clifford, Ashland, both of Mass.; Thomas Connolly, Nashua, N.H.; John R. Fairhurst, Lawrence, Mass.; Bruce Taylor, Manchester, N.H.

[73] Assignee: Roll Systems, Inc., Burlington, Mass.

[21] Appl. No.: 874,046

[22] Filed: Apr. 27, 1992

[51] Int. Cl.[5] ..... B65H 33/04

[52] U.S. Cl. ..... 270/95; 198/418.8

[58] Field of Search ..... 270/21.1, 58, 95, 52.5; 271/177, 181, 185, 198, 214, 215; 198/418.8

[56] References Cited

U.S. PATENT DOCUMENTS

| | | | |
|---|---|---|---|
| 1,208,465 | 12/1916 | Boreham | 198/418.8 |
| 3,089,394 | 5/1963 | Rauenbuehler | 198/418.8 |
| 3,587,413 | 6/1971 | Sarka | 198/418.8 |
| 3,866,765 | 2/1975 | Stobb . | |
| 3,871,644 | 3/1975 | Stobb . | |
| 3,969,993 | 7/1976 | Stobb . | |
| 3,982,749 | 9/1976 | Stobb . | |
| 4,014,535 | 3/1977 | Kleid | 270/21.1 |
| 4,361,318 | 11/1982 | Stobb . | |
| 4,732,262 | 3/1988 | Labombarde | 198/418.8 X |
| 4,941,650 | 7/1990 | Raybuck | 198/418.8 X |

FOREIGN PATENT DOCUMENTS

| | | | |
|---|---|---|---|
| 172273 | 7/1991 | Japan | 270/95 |

*Primary Examiner*—Edward K. Look
*Assistant Examiner*—John Ryznic
*Attorney, Agent, or Firm*—Wolf, Greenfield & Sacks

[57] ABSTRACT

An apparatus for stacking and separating sheets of web material provides a conveyor for transporting the sheets from a source of sheets. The sheets are conveyed in a stream that is aligned in a downstream direction from a source to a stacking location. A kicker mechanism is located along the conveyor to offset sheets in a direction that is substantially transverse to the downstream direction. A stacking mechanism is positioned at the stacking location for receiving each sheet from the conveyor and overlaying each sheet into a stack that extends downstream in a horizontal orientation that is substantially parallel to the ground. The kicker mechanism may include an elastomeric foot that engages and withdraws from each selected sheet to drive it transversely to the downstream direction. The sheets may be cut from a continuous web source.

53 Claims, 19 Drawing Sheets

TO/FROM PERIPHERALS
CPU 46

WEB-FED SHEET STACKER AND SEPARATOR

FIELD OF THE INVENTION

This invention relates to a stacker and separator of sheets.

BACKGROUND OF THE INVENTION

It is often desirable to process webs in large rolls upon which printing of individual sheets is placed while the web remains in a continuous form. At some point subsequent to various printing and processing operations, the web may then be separated into individual sheets which may be grouped in the form of jobs to be bound or otherwise collated.

A popular form of job separation, involves the tabbing of certain sheets in a stack. Tabbing generally involves forming an extended leaf on the end of the sheet that protrudes further out than other sheets in the stack. One such tabbing process, particularly for use with zigzag folded stacks is disclosed in applicant's U.S. Pat. No. 5,065,992. However, the tabbing of cut sheets is more problematic since each sheet is separate and movable relative to the others. Thus, it is not possible to form a tab by folding one sheet on top of another to a predetermined length.

Prior art job separators have distinguished between sheet sections using a process known as jog offset. By means of this process, entire sections are offset from each other as a stack is formed. However, such stacks are awkward and more difficult to handle. In addition, it would be more aesthetically and functionally desirable to include only one section separating tab page to mark each section. Until now, however, the insertion of a single offset page into a large stack has proven difficult due to the lack of beam strength exhibited by a single sheet.

A form of jog separator is described in U.S. Pat. No. 3,871,644 to Stobb. This patent utilizes a jogger to align sheets relative to one another in order to form an even stack.

Similarly, it may be desirable to stack sheets horizontally rather than vertically. By "horizontally" it is meant that each sheet is oriented vertically such that the overall stack appears to be on its side. It is significantly easier to remove certain mid and end sections from a stack that is horizontal, since there is no need to lift any portion of the stack away to access these other sections. Furthermore, a horizontal stack may be made larger than a corresponding vertical stack since the stack is not limited by ceiling height or the reach of a person. Such a horizontal stack is also more stable since its weight is evenly distributed over a proportional area of stack support. The formation of a horizontal stack is shown, for example, in U.S. Pat. No. 4,361,318 also to Stobb. This device provides no offset to sheets.

SUMMARY OF THE INVENTION

It is therefore an object of the present invention to provide a web stacker and separator that separates individual sheets from a continuous web and forms the sheets into one or more stacks having tabbed sheets for marking sections.

It is another object of this invention to provide a web folder stacker and separator that forms separator sheets into horizontal stacks of variable length.

It is another object of the present invention to provide a web stacker and separator that allows sections to be distinguished by differing length and differing orientation tabs.

It is another object of this invention to provide a web stacker and separator that allows programmable variation of stack size, sheet size, and number of stacks of separated sheets processed from a continuous web.

It is yet another object of this invention to provide a web stacker and separator that may be integrated with other standard web processing components.

An apparatus and method for stacking and separating sheets of a web material provides the transportation of sheets by means of a conveyor in a downstream direction from a source to a stacking location. Selected sheets are kicked into an offset position in a direction substantially transverse to the downstream direction as they pass along the conveyor. At the stacking location, sheets are stacked by means of a stacking mechanism into a horizontally oriented stack that is parallel to the ground. The conveyor is oriented substantially horizontally and, thus, sheets are driven from a horizontal to a vertical orientation as they pass from the conveyor to the stacking mechanism.

The kicker can comprise a frictional foot that engages and withdraws from each selected sheet to drive it into an offset position. Alternatively, the kicker can comprise an elastomeric rotating wheel that either rotates a metered amount or rotates continuously upon engagement of each sheet. If the wheel rotates continuously, a stop can be utilized to limit sheet offset.

The parameters of the stacker and separator may be varied to accommodate different size sheets and more than one side-by-side stream of sheets at once. In the event that more than one stream of sheets is directed through the conveyor, a plurality of corresponding kicker mechanisms may be utilized for offsetting selected sheets in each stream.

BRIEF DESCRIPTION OF THE DRAWINGS

The foregoing and other objects and advantages of the invention will become more clear with reference to the following detailed description and brief description of the drawings in which.

DETAILED DESCRIPTION

Figures 1, 2:
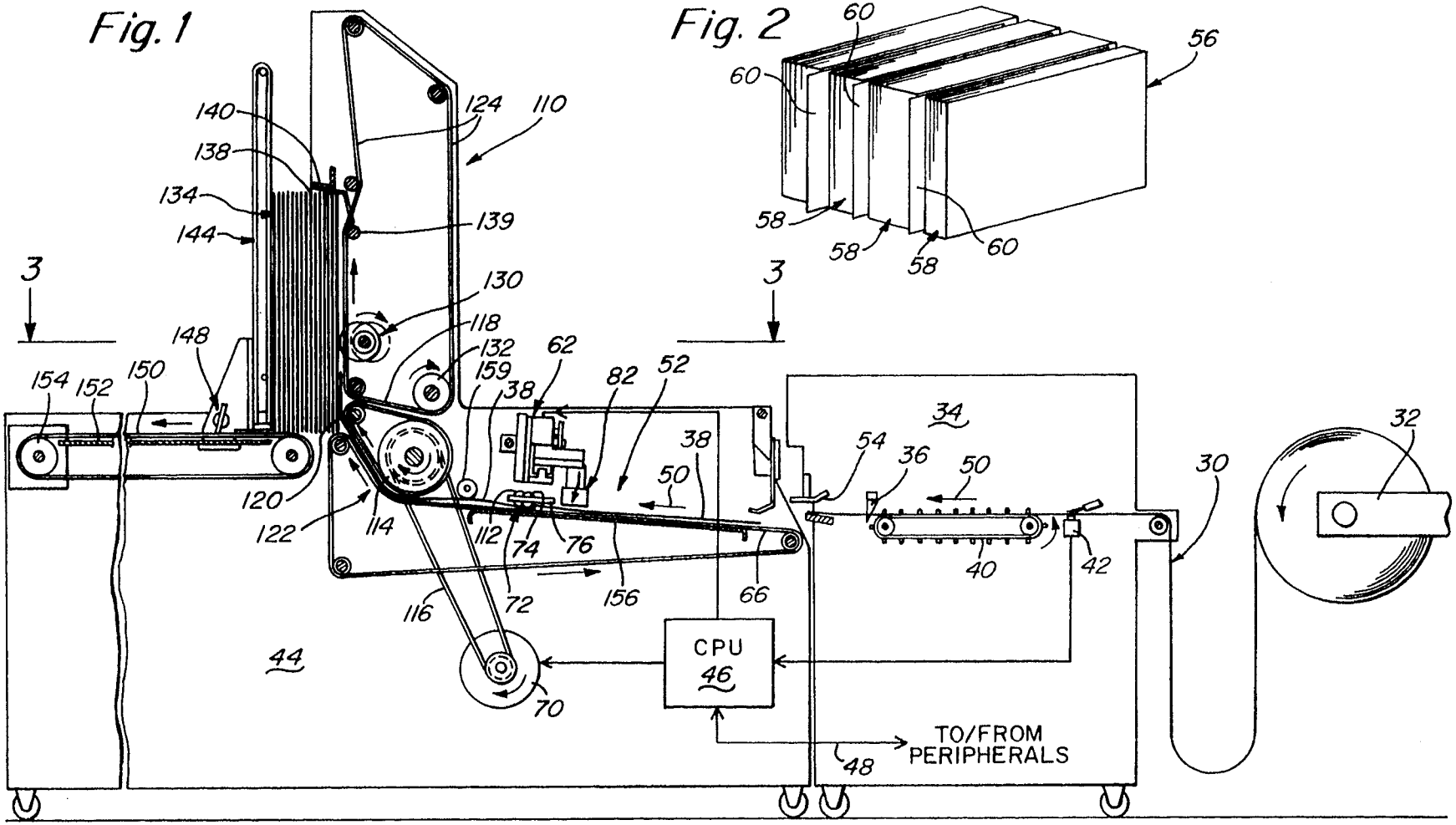
FIG. 1 is a schematic side view of a web stacker and separator according to this invention.
FIG. 2 is a schematic perspective view of a horizontal stack of sheets including tab sheets produced by the web stacker and separator according to this invention.

A web stacker and separator according to this invention is depicted in FIG. 1. A continuous web 30 that, generally, includes printing and other improvements performed in prior operations is fed from a roll stand 32 (shown partially) to a cutting unit 34 having a blade 36 for separating sheets 38. A drive belt 40 for feeding the continuous web 30 to the blade 36 is attached downstream of the roll stand 32. The cutting unit 34, according to this embodiment, also includes, at a position upstream of the drive 40, a sensor 42 that reads the input web 30 for various codes (not shown) that instruct the mechanisms of the depicted cutting and stacking units 34, 44 to perform specific operations. A CPU 46 is programmed to read these codes from the sensor 42. Note that sensed codes, according to this embodiment, are optional and the web stacker and separator according to this invention may be operated by means of internally preprogrammed commands or by means of commands 48 transferred from upstream peripherals and web processing devices (not shown).

The cutting unit 34 according to this embodiment includes a drive 40 adapted to convey web having tractor pin feed holes. Prior to sheet separation, the tractor pin feed edges may be removed from each sheet in order to create smooth standard shape sheets. Alternatively, a drive utilizing non-pin feed web may be employed.

Downstream of the cutting unit 34 is located the stacking unit 44 according to this invention. As stated herein, stacking unit 44 shall refer to the entire module shown in FIG. 1 positioned downstream of the cutting unit 34. The stacking unit 44 is positioned to receive cut sheets 38 from the cutting unit 34 as they are transferred downstream as shown by the flow arrows 50.

These cut sheets 38 are transferred onto a substantially horizontal conveyor section 52 of the stacking unit 44 using a suitable sheet advancing mechanism. In this example, a guide 54 directs driven sheets 38 from the cutting unit 34 onto the conveyor 52. This arrangement allows modular interchangeable devices to be mated to one another without the need of permanent attachment. An advantage of the stacker and separator according to this invention is that it is readily adaptable to a number of different peripherals and may even be controlled without interconnection to these peripherals and, rather, as discussed above, based upon preprinted control instructions upon the web or even upon its own internal command instructions.

FIG. 2 details the output stack 56 possible using the stacker and separator according to this invention. As will be discussed further below, the stacking unit 44 according to this invention particularly allows the formation of horizontal stacks of cut sheets 58 that include offset sheets 60 disposed between sections. These offset sheets 60 carry exposed edges that serve as tabs to mark each section. They may include preprinted markings or other identification information helpful in determining the section contents.

The formation of offset tab sheets is enabled by a kicker mechanism 62 mounted in the stacking unit 44. A cover is usually provided to protect the mechanism. It is removed herein for greater clarity. The mechanics of this kicker mechanism 62 are detailed more closely in FIGS. 3 and 4–6. The following discussion will be made in reference to each of these figures, as well as FIG. 1.

Sheets are fed, as noted, from the cutting unit 34 onto a conveyor 52 positioned, in this example, in a trough-like structure having substantially perpendicular sidewalls 64. The conveyor 52 comprises a series of elastomeric belts 66 that strongly grip the sheets 38 and maintain them in a predetermined alignment upon the conveyor as they flow downstream. A set of relatively lightweight cloth straps 68 overlie the sheets in the trough section of the conveyor 52 in order to maintain them with minimal normal pressure against the frictional conveyor belts 66 and to prevent them from establishing aerodynamic lift off the conveyor surface. The conveyor belts 66 are moved, in this embodiment, by means of a central drive motor 70 (FIG. 1) that interconnects a number of conveyor-like belts in the stacking unit.

The CPU 46 (FIG. 1) directs a drive motor (not shown) of the cutter and the drive motor 70 of the stacking unit 44 to intermittently stop each sheet 38 with its leading edge 72 proximate the kicker mechanism 62 according to this invention. In particular, each sheet 38 is stopped momentarily with its leading edge 72 positioned under a pair of weighted rollers 74 which, in this example, are large (approximately 1 inch diameter) ball bearings positioned within a plate 76 having holes 78 to rotatably receive the balls 74. The plate 76 may be constructed of clear Lucite TM or similar clear or opaque material with low friction. The balls 74 in this embodiment are free to move upwardly to accommodate different thickness webs.

When the CPU 46 receives appropriate instructions from its programmed memory or from other command sources such as coding upon the input web, a foot 82 of the kicker mechanism 62 is activated, driving the sheet, in this embodiment, to the left. The foot 62, as detailed in FIGS. 4–6, includes an elastomeric pawl 84, shaped as a cloven hoof herein, that generates substantial friction in contact with a web material such as paper. Hence, the full motion of the foot 82 is translated into side sliding motion of the engaged sheet 38.

It is important to note that each sheet 38, according to this embodiment, is driven from the cutting unit so that it overlaps the trailing edge of the downstream sheet. This overlap is detailed generally in FIGS. 3 and 3A. The overlap between sheets is largely variable. Sheets, in fact, may be subgathered at the kicker location so that the spacing between sheet leading edges is relatively close. Such subgathering is accomplished, according to one embodiment, by slowing the rate of advance of the conveyor belts 66 relative to the speed of entry of sheets onto the conveyor belts from the cutting unit 34. In this manner, sheets tend to overlap substantially as they move along the conveyor. An optimal spacing for leading edges is based upon the positioning of components in the stacking mechanism which will be described further below with reference to FIG. 7. Such spacing can, according to this embodiment, be 1½ inch.

Figure 3:
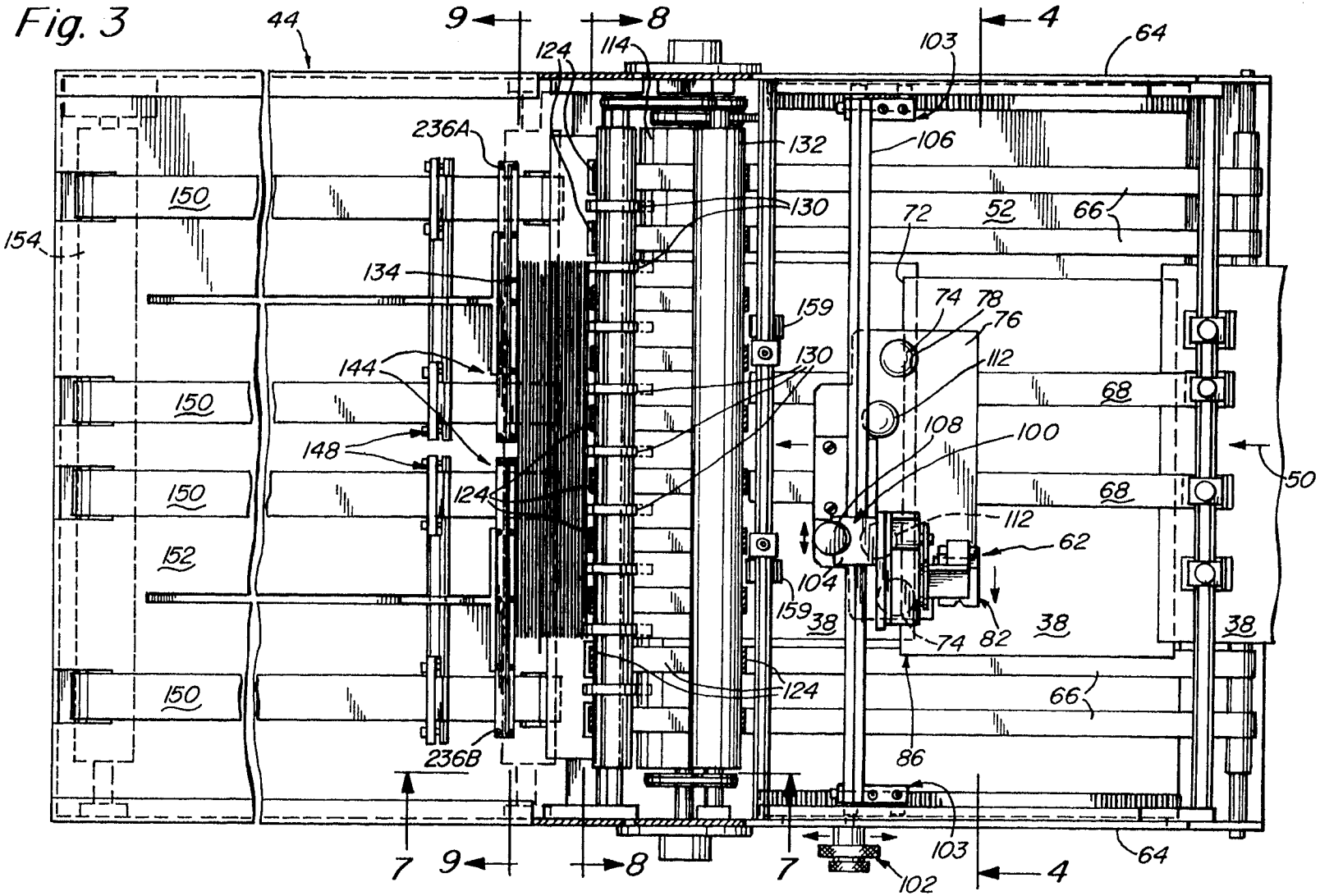
FIG. 3 is a more detailed top view of the web stacker and separator taken along line 3—3 of FIG. 1.
Figure 3A:
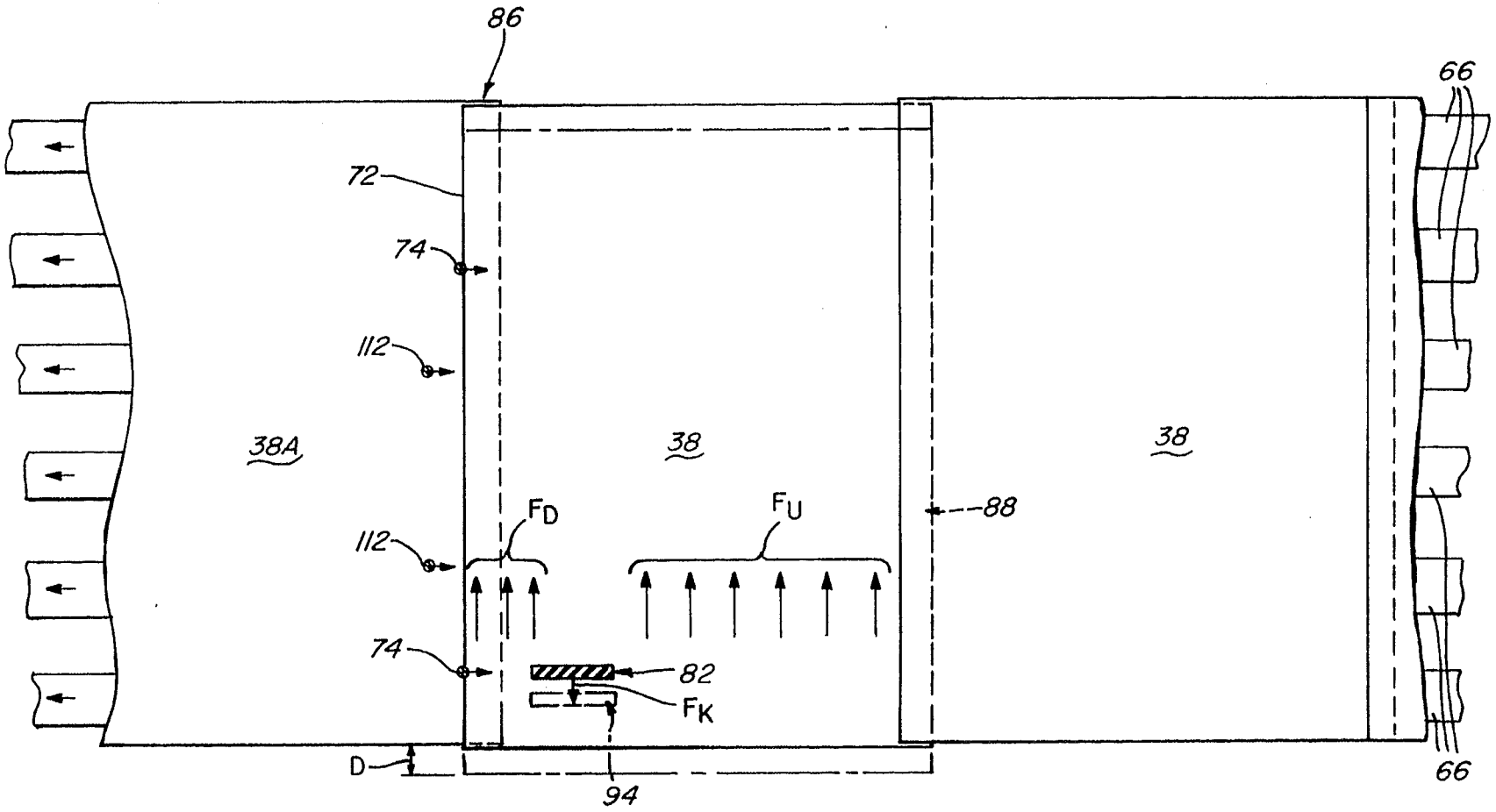
FIG. 3A is a schematic top view of a sheet moved into an offset tab position including force balances according to this invention.

As depicted in FIGS. 3 and 3A, the kicker foot 82 is positioned proximate the leading edge 72 of the sheet 38 positioned thereunder. The exact upstream-downstream positioning is determined by the necessary force balance resulting from friction generated between the kicked sheet 38 and the surface underlying it. In particular, the somewhat heavy leading edge balls 74 generate substantial frictional resistance between the kicked sheet and the underlying downstream sheet 38A (FIG. 3A) at the overlap point 86. Note that the overlap particularly aids in reducing friction since direct contact between the weighted sheet 38 and the rubber conveyer belts 66 would generate an extremely strong frictional resistance force that would generally resist applied kicking forces.

The trailing section 88 of the sheet 38 is relatively unweighted, but still experiences some friction due to its contact with conveyor belts 66 located upstream of the kicker foot 82. Hence, the kicker foot 82 is positioned so that the sum of the partial frictional forces $F_U$ upstream of the kicker foot equals the sum of the frictional forces $F_D$ downstream of the kicker foot 82 (FIG. 3A). The kicking force $F_K$ is greater than $F_U+F_D$. As such, the sheet 38 moves evenly to the side even when kicked over a small portion of its area.

According to this embodiment, the weighted balls 74 have an advantage over other forms of rollers since they move freely in all directions given their simple hole mounts in the plate 76. Thus, they allow upstream to downstream motion of sheets as well as free side-to-side motion of sheets.

Figure 4:
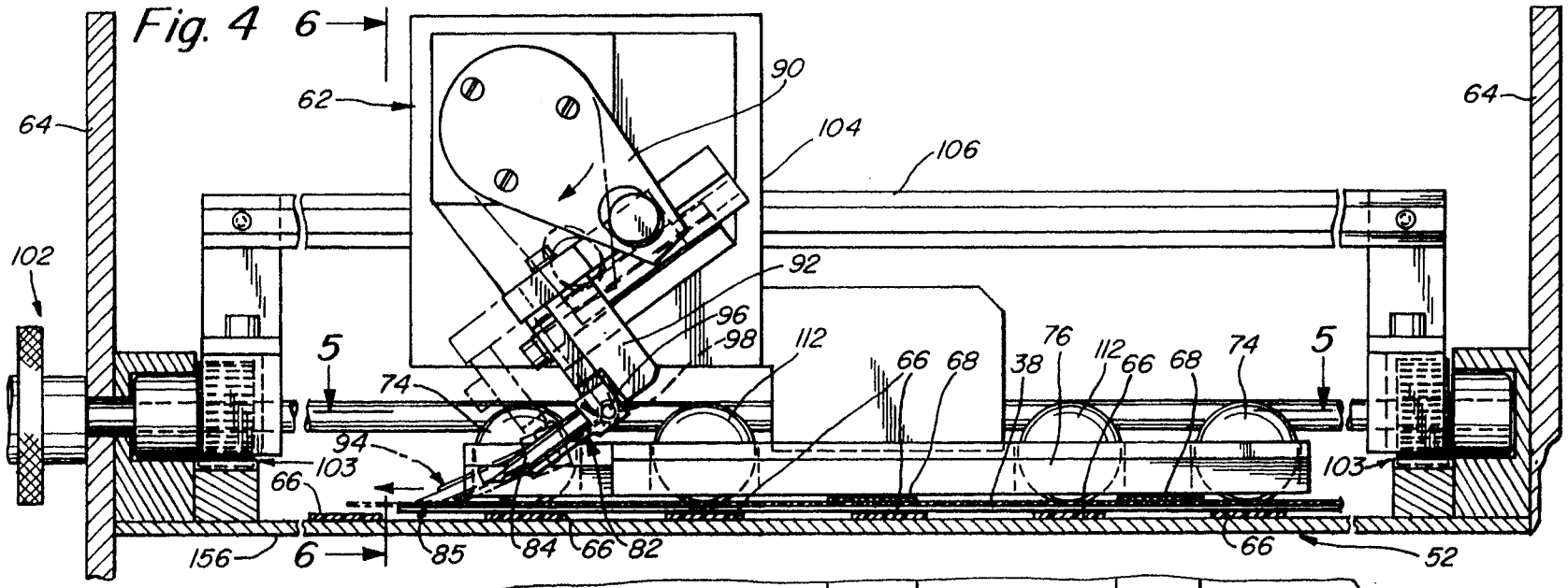
FIG. 4 is a more detailed front view of the sheet kicker mechanism for creating offset tab sheets taken along line 4—4 of FIG. 3.
Figure 5:
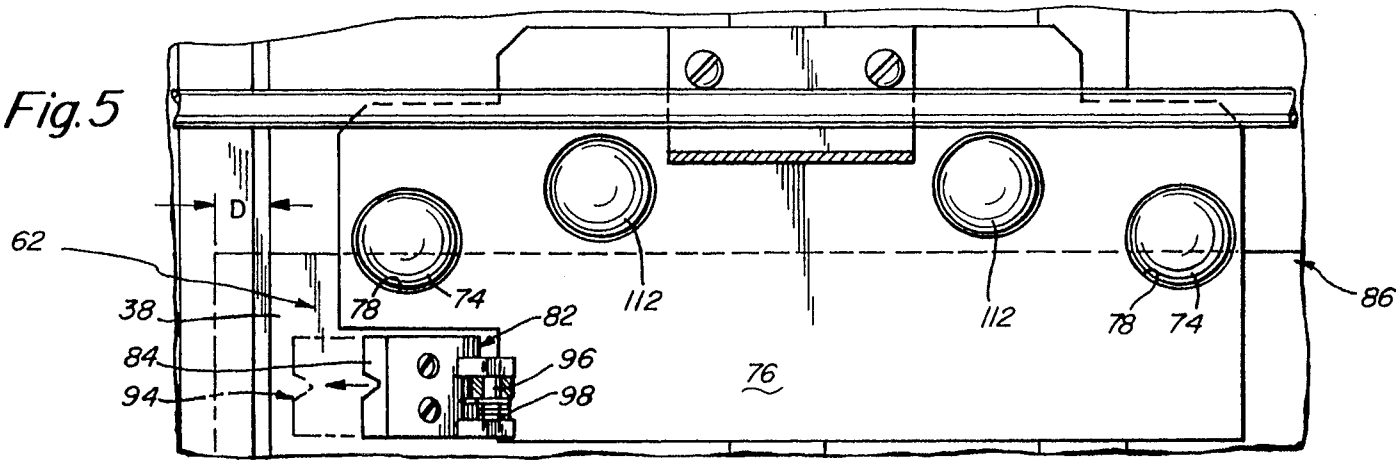
FIG. 5 is a more detailed top view of the tab sheet hold down assembly taken along line 5—5 of FIG. 4.

It is further important that the static frictional force generated by the kicker foot 82 as it contacts the sheet 38 be greater than the total frictional force ($F_U+F_D$) resisting side movement. In this way, the sheet translates freely to the side when kicked. This force should be primarily side acting and not overly normally (vertically) directed to avoid further pressing of the sheet 38 onto the conveyor belt 66, as this would increase the frictional resistance to side movement of the sheet. In the depicted embodiment as shown in FIG. 4, actuation of the kicker foot 82 and subsequent production of a constant side acting kick force is generated by means of a lever arm 90 interacting with a slide mounted foot carriage 92.

The foot translation is defined along a direction from the neutral position, out of contact with the sheet 38, to a fully extended position 94 (shown in phantom) in which the sheet 38 is translated a distance D. The carriage 92, is mounted at an angle of approximately 40° relative to the sheet surface in this example and moves downwardly in response to a rotary motion of the lever arm 90 in order to bring the kicker foot 82 into engagement with the sheet 32.

If the foot 82 were fixedly attached to the carriage 92, it would direct its force at a downward angle, causing the sheet 38 to bind upon the conveyor surface. Hence, the foot 82 is mounted upon a pivot 96 allowing it to swing upwardly relative to the sheet surface. The pivot 96 includes a biasing spring 98 that maintains the foot 82 in a downward position. The spring 98, however, is set in force to allow the foot 82 to pivot upwardly as it engages the sheet 38 with a predetermined contact force. Thus, the vertical component of contact force never exceeds a predetermined value. This value, of course, is regulated by the spring constant of the foot biasing spring 98. The vertical component of force is sufficient, however, to ensure that the frictional pawl 84 of the foot 82 applies sufficient gripping normal force to overcome the resistant frictional force acting upon the lower surface of the sheet. Hence, smooth and positive side translation is possible.

The pawl 84 of the foot 82 defines a contact plane 85 (FIG. 4) that is substantially parallel to the surface of the sheet. The pawl comprises a closed cell foam having a high co-efficient of friction. Thus, the normal force provided by the spring 98, in combination with the angle of attack of the foot as it contacts the sheet, provides very secure locking of the foot relative to the sheet. The pawl, therefore, maintains secure and non-slidable contact with the sheet as it translates to the side. This ensures predictable and repeatable kicking of sheets.

Figure 6:
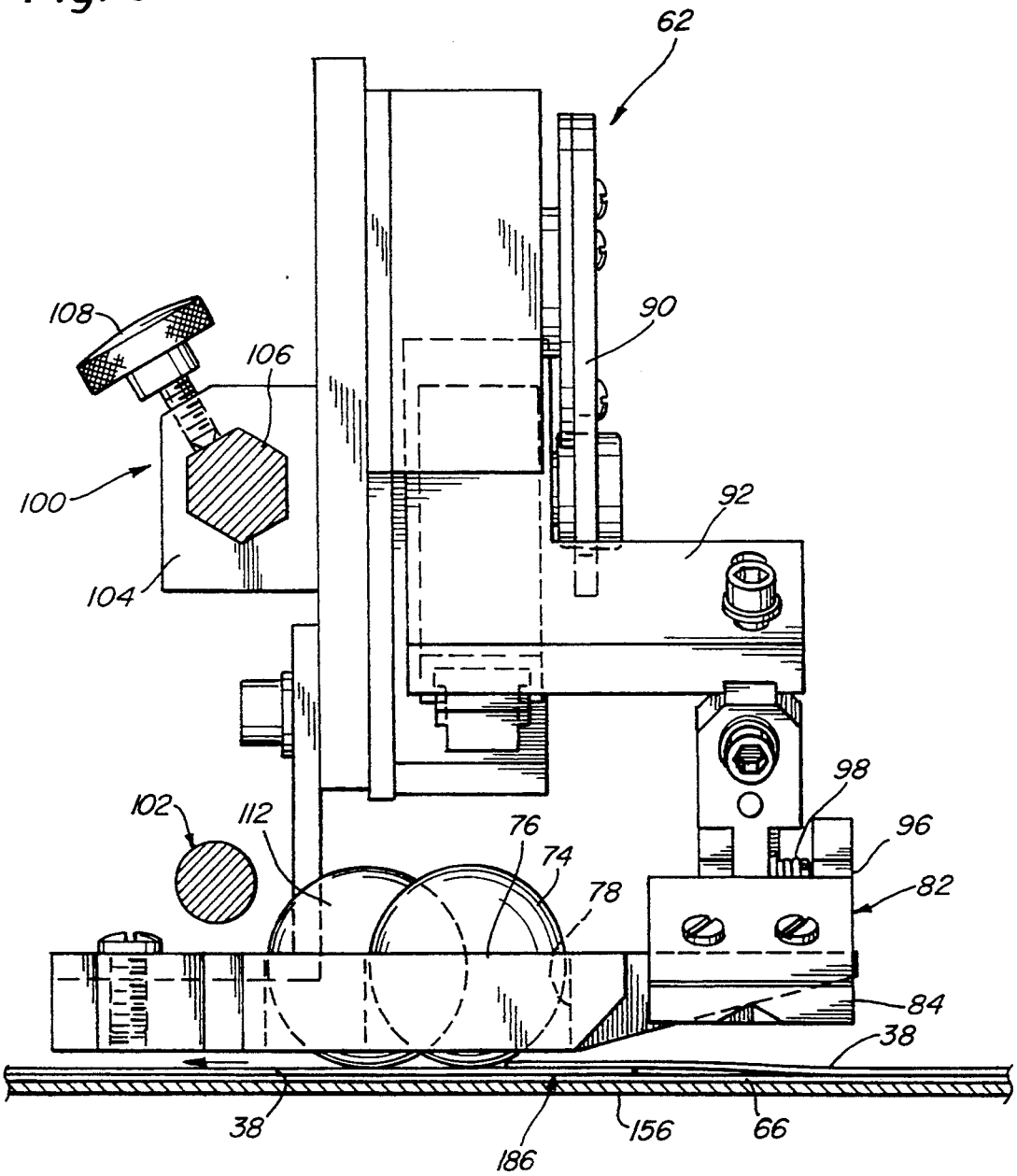
FIG. 6 is a more detailed side view of the sheet kicker mechanism taken along line 6—6 of FIG. 4.

The rotary lever arm 90, according to this embodiment, may be actuated by a variety of devices including a rotary solenoid, a stepper motor or a rotary pneumatic cylinder. It is important in this particular embodiment that the lever arm 90 have limited motion. This may be accomplished by means of stops on the carriage or rotary stops on the lever arm (not shown). The kicker mechanism according to this embodiment includes left/right and upstream/downstream positioning units 100 and 102 respectively. These allow the kicker foot 82 to be positioned precisely upon a point of each underlying sheet based upon the size of the sheet. In this embodiment, upstream/downstream adjustment is accomplished by means of a rack and pinion system 103 (FIGS. 3 and 4) while left/right adjustment is accomplished by means of a pillow block 104 and slide 106 arrangement (FIGS. 3, 4, and 6). Left/right positioning may be fixed by means of a lock screw 108 that bears upon the slide 106 (FIG. 6). Since the slide 106 is hexagonal, it rotatably fixes the pillow block 104 relative to the slide axis.

Adjustment of the position of the kicker mechanism 62 relative to the trough of the stacking unit 44 may be accomplished manually or by means of powered drives interconnected to the CPU (not shown). These drives would readjust the location of the kicker mechanism 62 based upon CPU commands derived either from peripheral devices, internal program steps or information read from an input web indicating a particular sheet size requiring certain programmed kicker positioning parameters.

Figure 8:
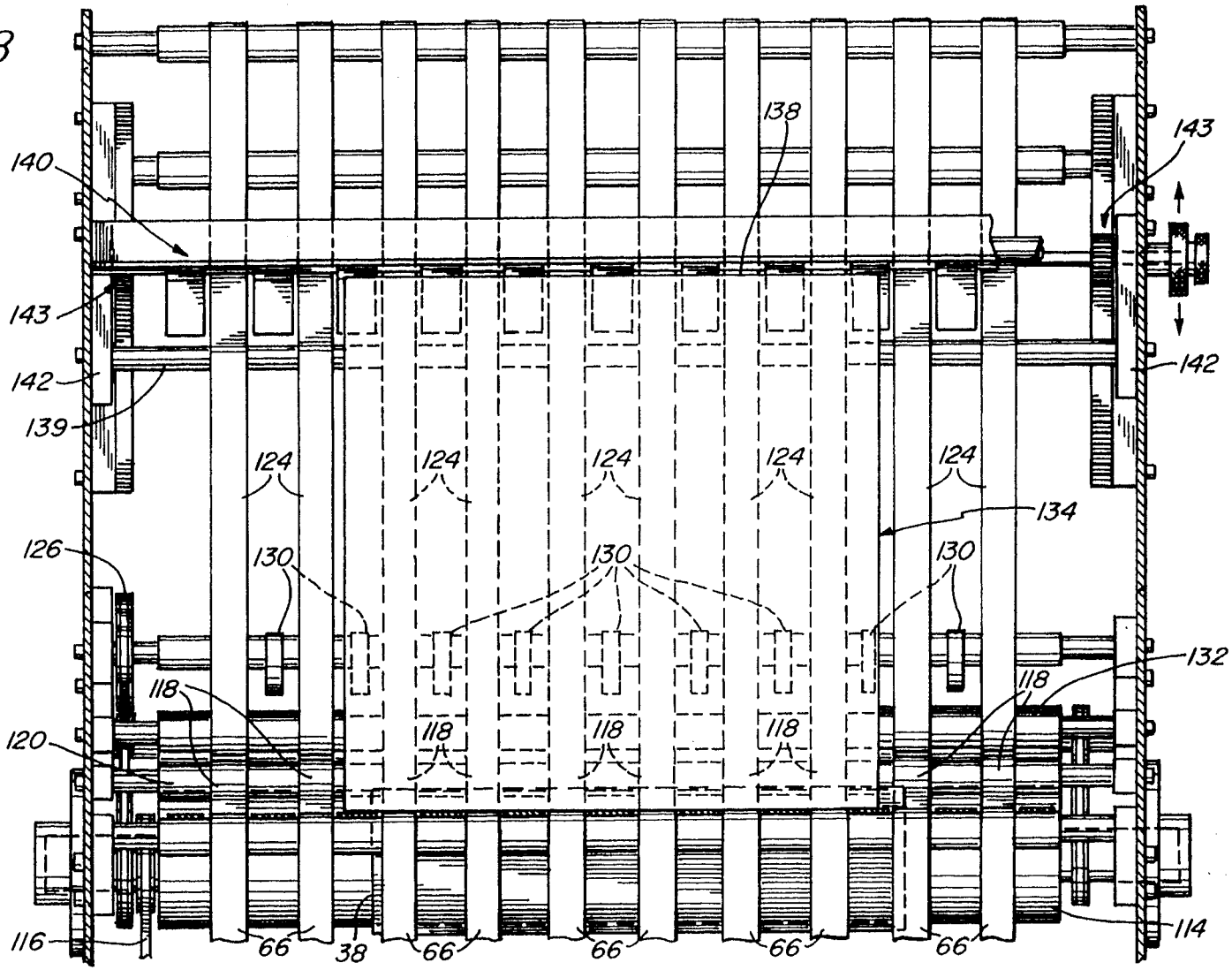
FIG. 8 is a more detailed rear view of the stack forming mechanism taken along line 8—8 of FIG. 3.
Figure 9:
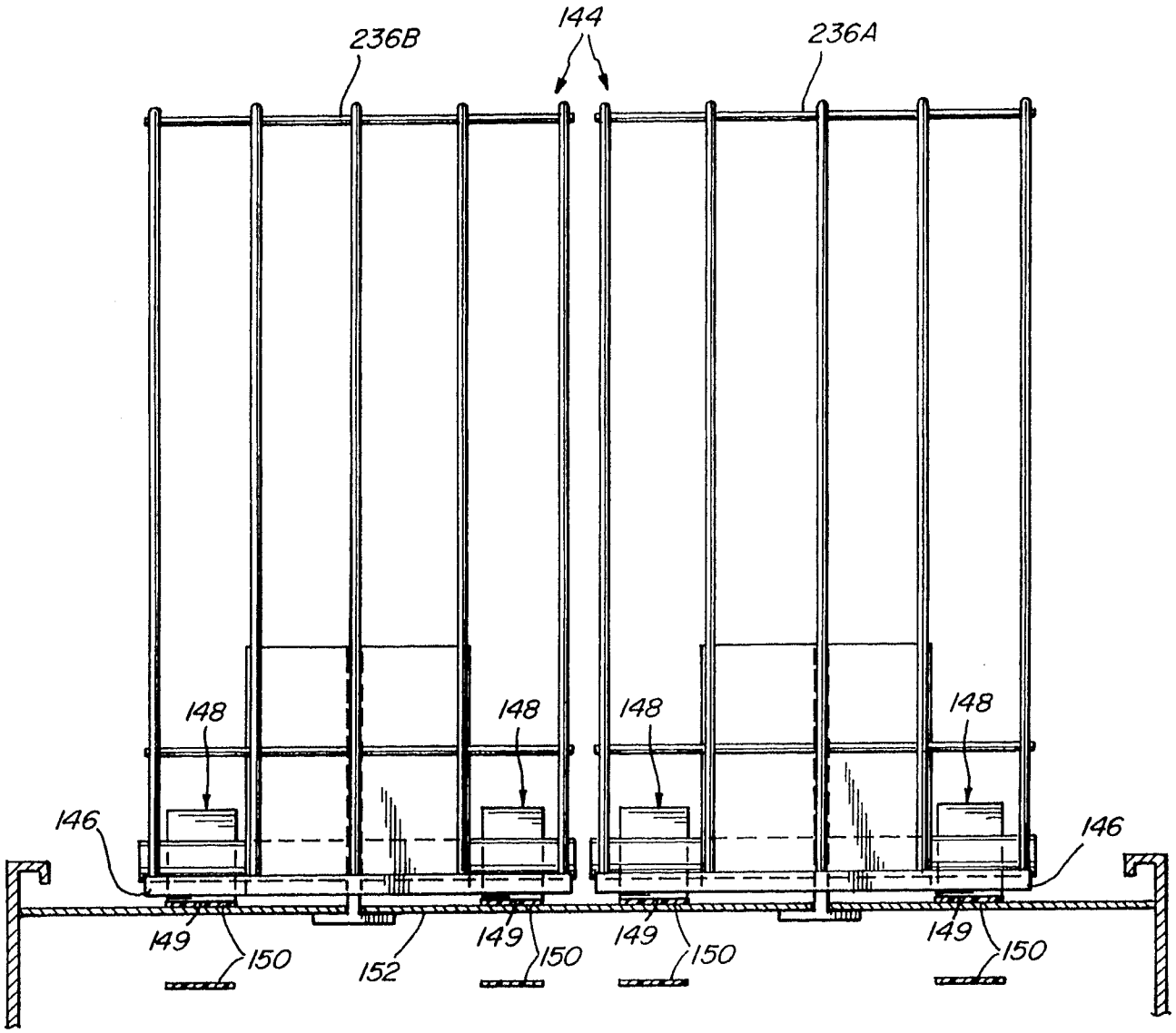
FIG. 9 is a more detailed front view of the stack backing support assembly taken along line 9—9 of FIG. 3.

Once each sheet has passed through the kicker mechanism and stopped relative thereto, it moves incrementally into the stacking mechanism 1100 The sheet 38 enters into the stacking mechanism with its trailing edge still positioned relative to a downstream pair of weighted rollers 112 in the kicker mechanism plate 76 (FIG. 3). These rollers 112 maintain the sheet in straight alignment as it enters the stacking mechanism 110. The stacking mechanism 110 is, itself, depicted further in more detail in FIGS. 7–9. The following discussion will be made with reference to these figures.

Figure 7:
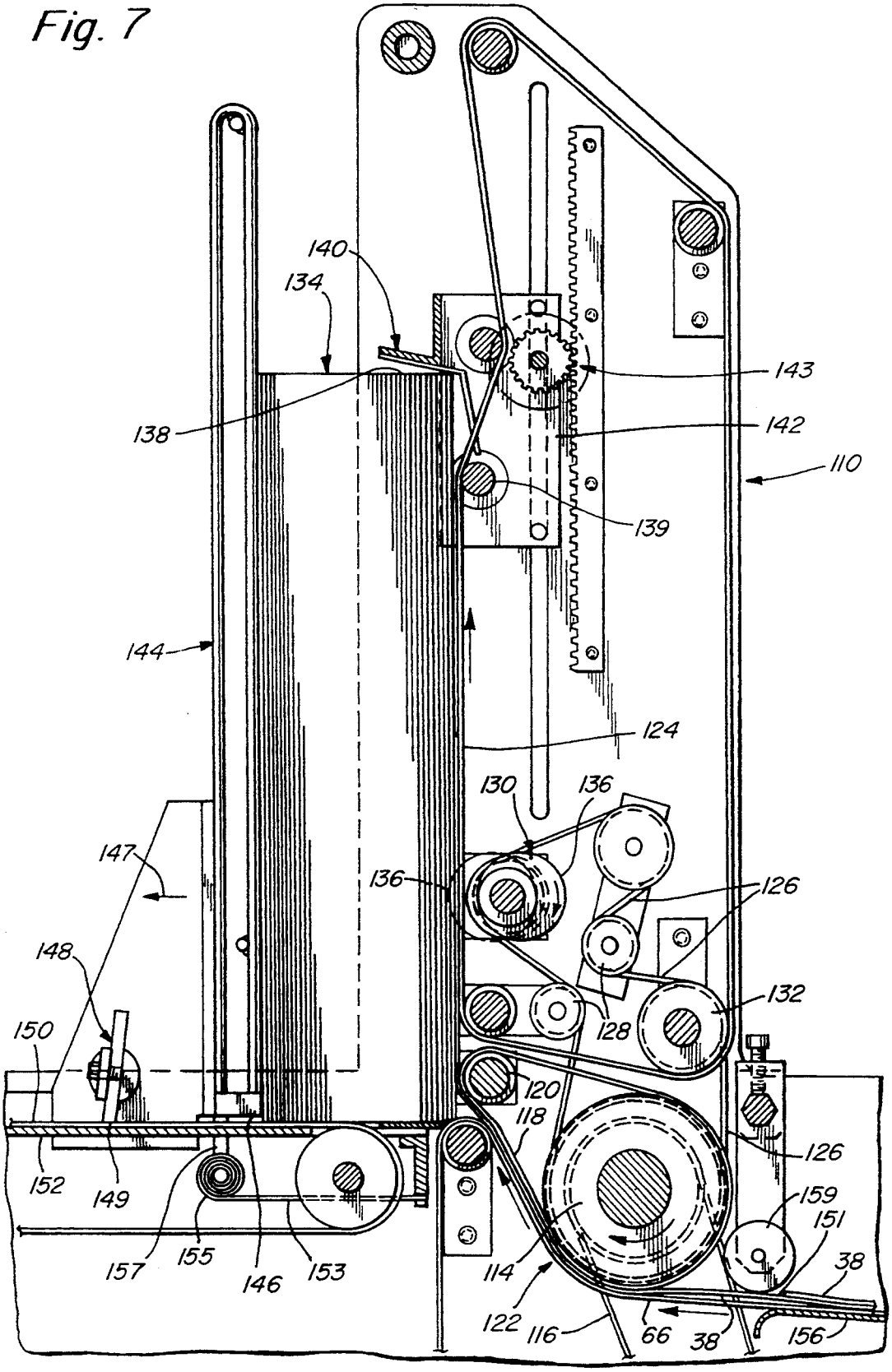
FIG. 7 is a more detailed side view of the web stacker and separator of FIG. 1 detailing the horizontal stack forming mechanism taken along line 7—7 of FIG. 3.

FIG. 7 shows a more detailed side view of the stacking mechanism 110 of FIG. 1. As noted above, the entire stacking unit 44 is driven by a unitary drive motor 70 in this embodiment. In particular, a main drive roller 114 is interconnected with a drive belt 116 from the drive motor 70 that rotates at a programmed speed in increments to transfer sheets through the stacking unit 44. The main drive roller 114 is directly interconnected with a set of diagonal conveyor belts 118 stretched between the main drive roller 114 and a smaller upwardly and downstream positioned follower roller 120. The diagonal belts 118 each correspond in a widthwise direction to one of the conveyor belts 66 in the trough section of the stacking unit 44. The trough conveyor belts 66 are positioned intermesh with the diagonal belts 118 and move in concert with the diagonal belts 118 according to this embodiment, deriving their driving force from the diagonal belts 118.

A sheet 38, when exiting the kicker mechanism 62, enters the region 122 between the intermeshing diagonal and trough belts. The sheet 38 is driven in this intermeshing region from a substantially horizontal to a vertical orientation around a curve in the belts 116 formed by the drive roller 114 and follower roller 120. As the leading edge 72 of the sheet 38 leaves the intermeshing belt region 122, it enters a set of vertically disposed stacking belts 124. These belts 124 are driven by a second drive belt 126 interconnected with the main drive roller 114. The second drive belt 126, particularly, engages an idler arrangement 128, a set of cams 130 and a vertical belt drive wheel 132. The diameters of the main drive roller 114 and vertical belt drive wheel 132 are chosen so that the vertical belts 124 move at a slightly faster rate than the trough conveyor belts 66 and diagonal belts 118. This allows the vertical belts 124 to account for a speed differential as sheets are moved around the curve out of the intermeshing region 122 into a vertical orientation in the sheet stack 134. In other words, sheets increase in tangential velocity from their horizontal position in the trough to their vertical position as they enter the stack 134.

The rotating cams 130 according to this embodiment are spaced at even intervals between each of the adjacent vertical belts. The cams 130 are timed so that their outwardly extended eccentric portions 136 (FIG. 7) bear upon the upstream side of the stack 134. In this manner, as the sheet is driven upwardly into the stack 134, it has clearance from the other sheets in the stack. By the time the sheet rises vertically to reach the cam 130, the cams have rotated out of an engaging position with the stack 134, allowing the newly entering sheet to pass upwardly into the stack 134 without interference. The eccentric portions 136 of the cams 130 continually return to an engaging position with the stack, to continually form clearances in the stack 134 for each successive input sheet to be added to the stack 134.

The cams 130 also serve to remove the sheets from engagement with the vertical belts 124. Otherwise, the sheets would have a tendency to continue their upward movement, following the belts 124 beyond the top 138 of the stack 134. Hence, the belts 124 can also be angled slightly away from the upstream face of the vertical stack 134 so that the face sheet will have no tendency to contact the belts 124 after it has become part of the stack.

The upper height limit of the stack 134 is maintained by means of one or more stops 140 positioned across the top 138 of the stack 134. These stops 140 assist in preventing the input sheet from continuing upwardly any further than the top 138 of the existing stack 134. Note that the stops 140 are vertically adjustable, in this embodiment, by means of a carriage 142, to which the stops are mounted. This adjustment mechanism, which is a rack and pinion system 143 in this embodiment, can be manually operated or, alternatively, can rely upon a controlling motor (not shown) that receives stack size and sheet size commands from the CPU and, accordingly, adjusts the vertical position of the stops 140. Furthermore, since sheet size is, generally, known, both the vertical (stops) and horizontal (kicker) positioning can be readjusted by the controls in response to an input sheet size value in concert. The controls can be joined by either a mechanical or electronic link to allow simultaneous proportional movement of the vertical and horizontal parameters.

As discussed above, with reference to FIGS. 3 and 3A, sheets are overlapped as they enter the vertical stacking belts 124. Since subgathering may occur along the conveyor section, it is possible to closely space the leading edges of overlapping sheets prior to their entry into the stacking mechanism 110. According to this embodiment, an optimum spacing between overlapping sheet leading edges would be no less than the distance between the upper vertical driving roller 139 and the top stop 140. In this manner, a part of the vertically driven sheet is always in contact with at least a portion of the vertical belt 124. In other words, the next upstream sheet does not completely "blanket" the contacting portion of the belt before the preceding downstream sheet has risen to fully engage the stop 140. In one embodiment, the distance between the upper roller 139 and the stop is approximately 1½ inch. Accordingly, an overlap having approximately 1½ inch between sheet leading edges is generated.

The downstream end of stack is maintained upright by a set of stack backing rails 144. These rails 144 are more clearly shown in FIG. 9. The rails 144 extend vertically to a height substantially equal to the maximum height of possible stack formation. In this manner, the rails can accommodate any size stack. The rails can slide upon their base 146 in an upstream direction toward the stack 134, but are maintained in a vertical position and prevented from slipping downstream (arrow 147 in FIG. 7) by means of a set of brake blocks 148 positioned downstream of the rails 144. These blocks 148 engage each of a set of belts 150 positioned along a stack supporting and forming table 152. The belts 150 may comprise a flexible plastic material in this embodiment. The blocks 148 include elastomeric bases 149 that generate friction against the belts 150. Thus, any tendency of the stack to fall rearwardly (downstream) creates a moment about the stack base 146 that is translated into downward contact pressure between the elastomeric bases 149 of the blocks 148 and the plastic belts 150. As such, the blocks 148 firmly grip the belts 150. The belts 150 in this example include a friction roller 154 (FIG. 1) at a downstream most end of the forming table 152 that provides frictional resistance to downstream movement of the belts 150. As such, a substantial force is required to move the interengaged rails 144 and belts 150 downstream. This force is provided by means of the rotating cams 130 in engagement with the upstream stack face. However, the mere weight of the stack 134 should be insufficient to cause the belts 150 to move downstream. Note that the stack 134 is, in fact, supported in part by the belts 150 as it moves downstream during formation. This aids in maintaining a uniformly shaped stack, with even and parallel sheets therein.

While a moment created by the stack causes the stack base 146 to firmly engage the plastic belts 150, small lightly weighted stacks do not exert substantial force upon the rails 144. Hence, the rails may easily be moved rearwardly out of contact with the downstream end of the stack 134. Thus, the stacking mechanism 110 according to this embodiment provides a constant tension spring 153 that is positioned between the base 146 of the rails 144 and an upstream most portion of the forming table 152. The constant tension spring in this embodiment comprises a coiled leaf of spring material in which the coil 155 positioned on a mounting 157 that is attached to the rail base 146. As the rails move downstream, the spring leaf is paid out from its coil 155, and maintains a constant tension between the upstream portion of the forming table and the rails 144. In this manner, the rails 144 continue at all times to bear upon the downstream end of the stack 134 with a preset force.

A consequence of the use of constant tension spring 153 in this embodiment is the ability of the rails 144 to rapidly move upstream following removal of all or part of the sheets of the stack 134. Thus the user need not manually push the rails back into engagement with the downstream end of the stack or stacking belt 134 or stacking belt 124.

As noted above, the formation of a horizontal stack (vertically oriented sheets) allows for substantially larger stacks, than in vertical formation (horizontally oriented sheets). Once the stack is formed, all or part of it can be easily removed by lifting it off the forming table 152.

Since a speed differential is created between the horizontal and diagonal belt sections 66 and 118 respectively, a passing sheet may have a tendency to buckle or form a bubble 151 (FIG. 7) as it enters the diagonal intermeshing region 122 of the belts 66, 118. Hence, the stacking mechanism 110 according to this embodiment includes a set of flattening rollers 159 positioned immediately upstream of the main drive roller 114. The flattening rollers 154 are spaced approximately one-eighth inch above the surface of the flat conveyor section table 156 of the conveyor section 52. Any bubble or buckle 151 that may tend to form in a sheet is, thus, limited in its upward motion by means of the flattening rollers. By limiting the buckle to no more than approximately one-eighth inch, the natural stiffness of paper and similar web materials prevents the formation of a kink or wrinkle that would cause jamming of the mechanism. In this manner, smooth transmission of each sheet through the diagonal intermeshing region is achieved despite inherent speed differentials along the conveyor path.

It is important, according to this invention, that both the trough conveyor belts 66 and stacking mechanism 110 conveyor belts 118 and 124 include no side-to-side obstructions that would block the passage of an offset sheet. As depicted, the plurality of belts 66 in the trough and in both the diagonal (118) and vertical (124) portions of the stacking mechanism 110 are disposed substantially across the entire widthwise surface of the stacking unit 44. This positioning allows an offset, as well as a centered sheet, to pass freely into the formed stack 134 without any other external alteration of its orientation along its path of travel. Hence, the formed stack 134 may take the form of that depicted in FIG. 2 with variously offset sheets of different offset length protruding from the side of the stack.

According to this invention, it is possible to vary the distance of offset, and even to vary the orientation of offset. In other words, sheets may be translated both to the left side of the stack and to the right side of the stack variously. In order to accomplish such a complex tabbing structure within a stack, it is necessary to vary the direction and magnitude of transverse kicking of sheets according to this invention. The following discussion will describe a variety of alternative embodiments for performing more complex and different stacking functions according to this invention.

Figure 10:
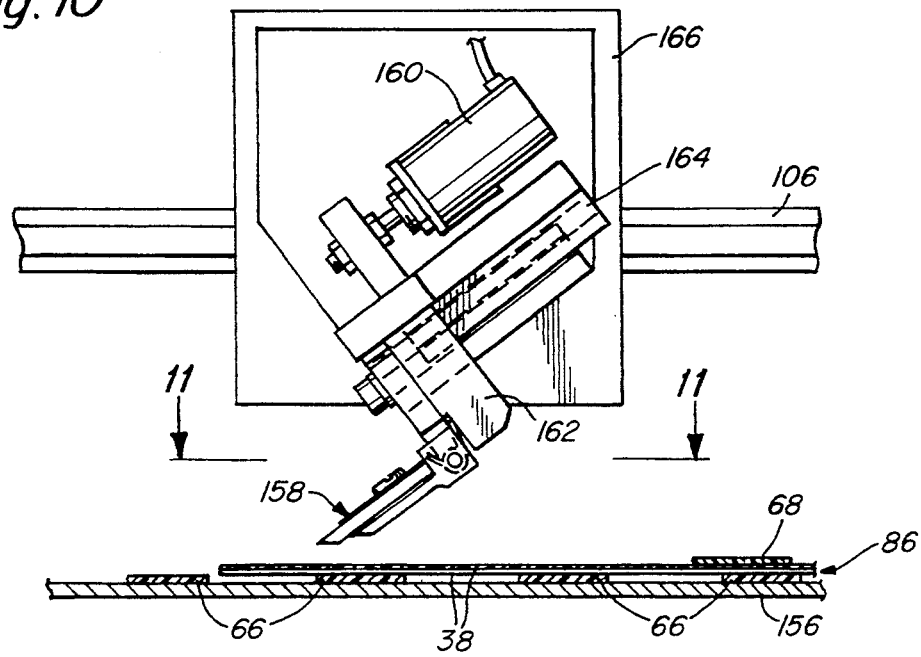
FIG. 10 is a somewhat schematic front view of a sheet kicker mechanism according to an alternative embodiment.
Figure 11:
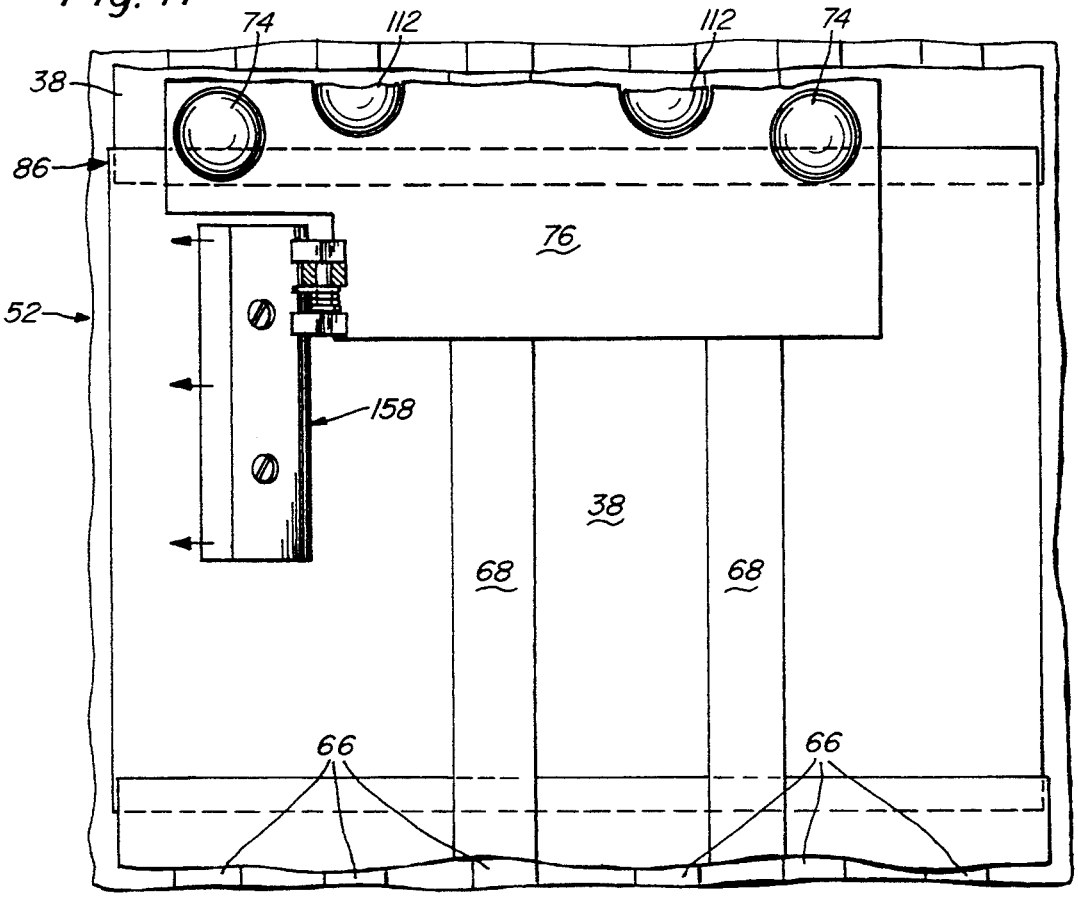
FIG. 11 is a schematic top view of the sheet kicker mechanism taken along line 11—11 of FIG. 10.

As discussed above, the actuation of the kicker mechanism may be accomplished by means of a variety of motors. FIG. 10 illustrates a pivoting, spring biased, kicker foot 158 that is activated by means of a linear motor 160 such as a linear electrical solenoid or a fluid driven actuator such as an air cylinder. This motor 160 moves the kicker foot carriage 162 at a downward angle along a slide 164 mounted to a bracket on the kicker mechanism base 166. The foot 158 according to this embodiment is more clearly detailed in FIG. 11. Unlike the embodiment of FIG. 1, this foot 158 is substantially wider. A wider foot may be employed to ensure more even translation of a sheet 38 to the side. There is less opportunity for a sheet to become misaligned as it translates sideways given a longer foot contact surface. It is important, however, when using a longer foot to insure that the foot contacts the sheet evenly and at the same time along its entire length. Otherwise, uneven translation of the sheet to the side may still result.

Figure 12:
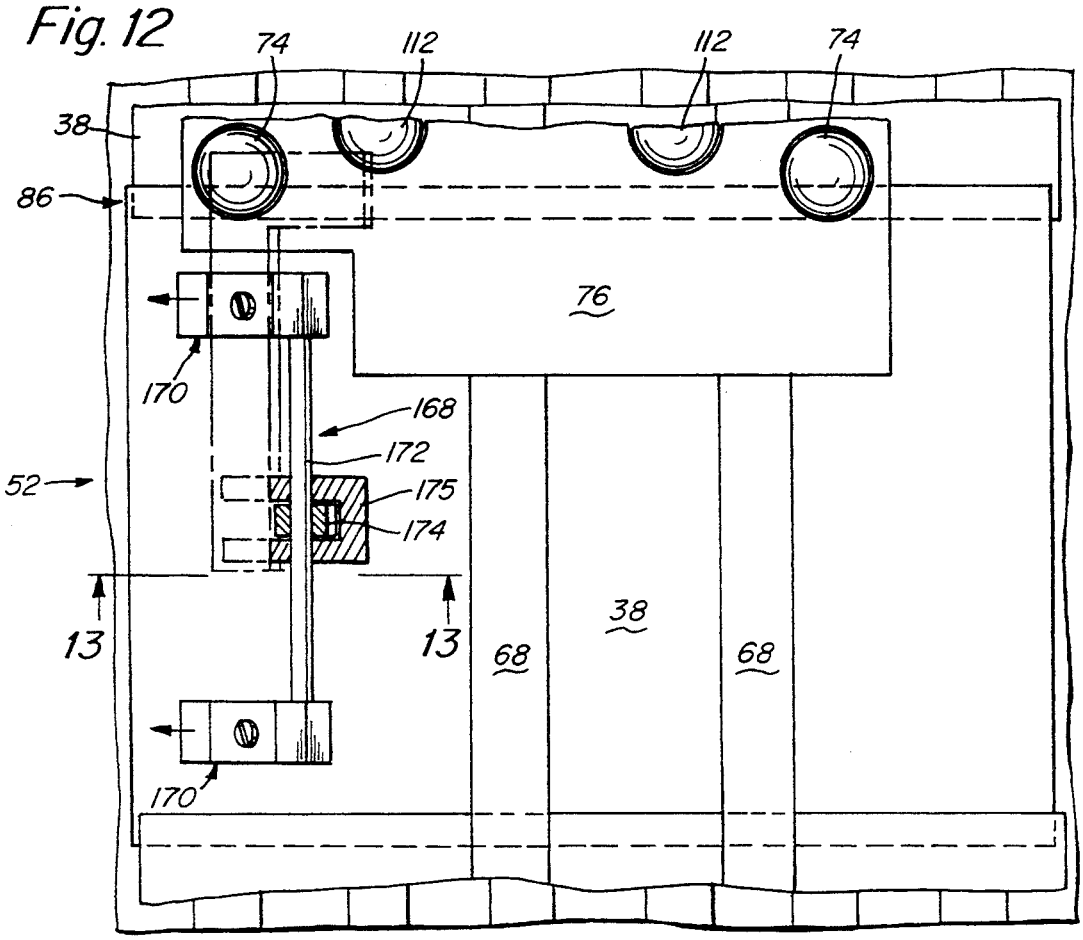
FIG. 12 is a schematic top view of yet another alternative embodiment of a sheet kicker mechanism according to this invention.
Figure 13:
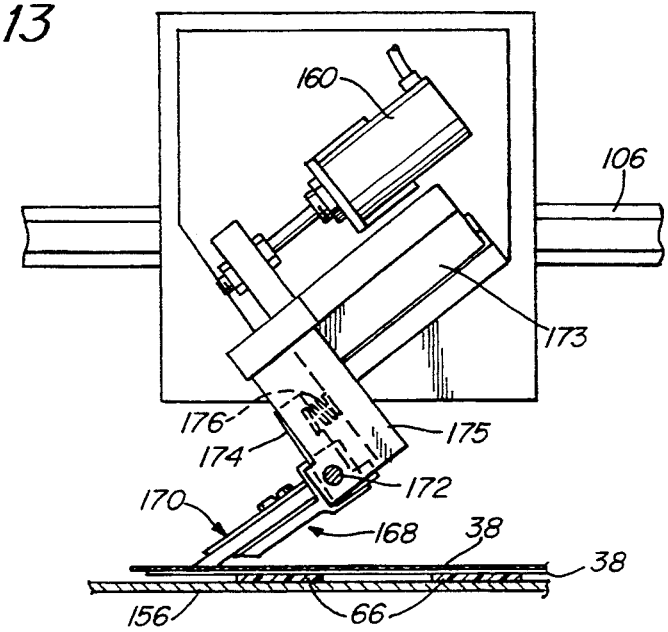
FIG. 13 is a schematic front view of the sheet kicker mechanism taken along line 13—13 of FIG. 12.

FIGS. 12 and 13 detail an alternative foot design according to this invention in which the foot 168 comprises two separate feet 170 joined by a connecting rod 172. The feet 170 act along a side of the sheet 38 proximate opposing upstream and downstream edges of the sheet to insure that it is translated evenly to the side. Again, it is important that each of the feet 170 contact the sheet at nearly the same time so that one edge is not led in sideways movement. In this embodiment, the linear motor 160 translates the connecting rod 172 diagonally downwardly carrying the two feet with it. The connecting rod, itself, includes an extended slide 173 carrying a carriage 175. The carriage 175 interconnects to a pivoting lever 174 and compression spring 176 arrangement that allows maintenance of a constant vertical engagement pressure of the feet 170 on the sheet 38.

Figure 14:
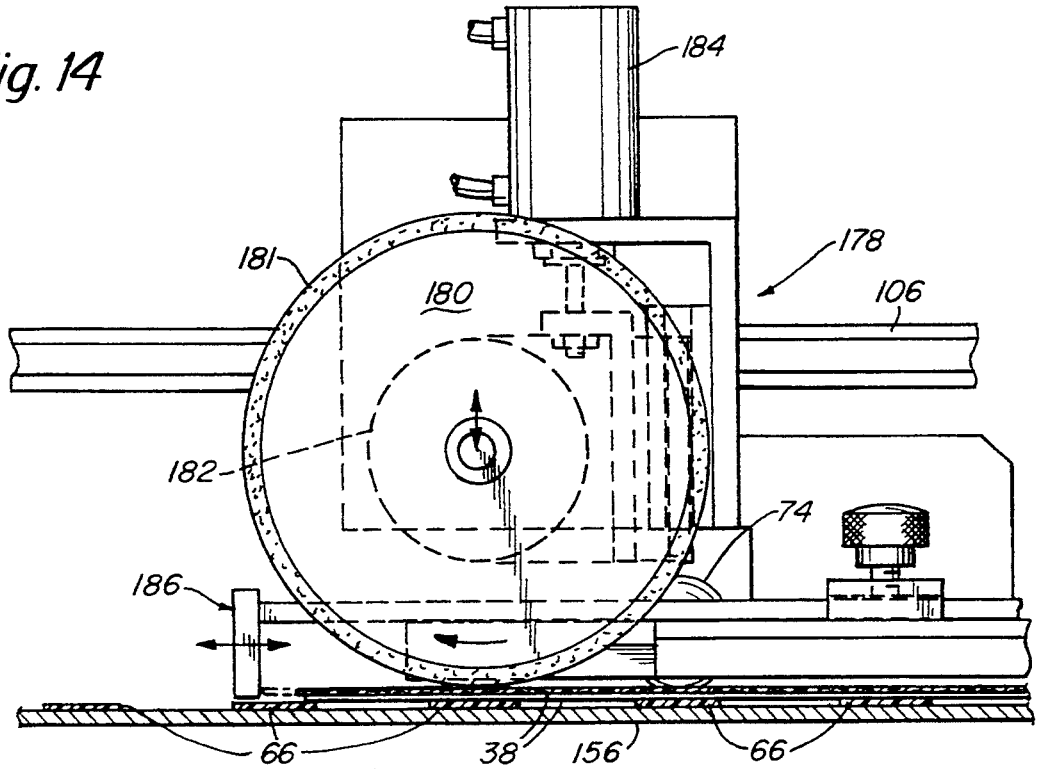
FIG. 14 is a somewhat schematic front view of another alternative embodiment of a sheet kicker mechanism using a friction wheel according to this invention.
Figure 15:
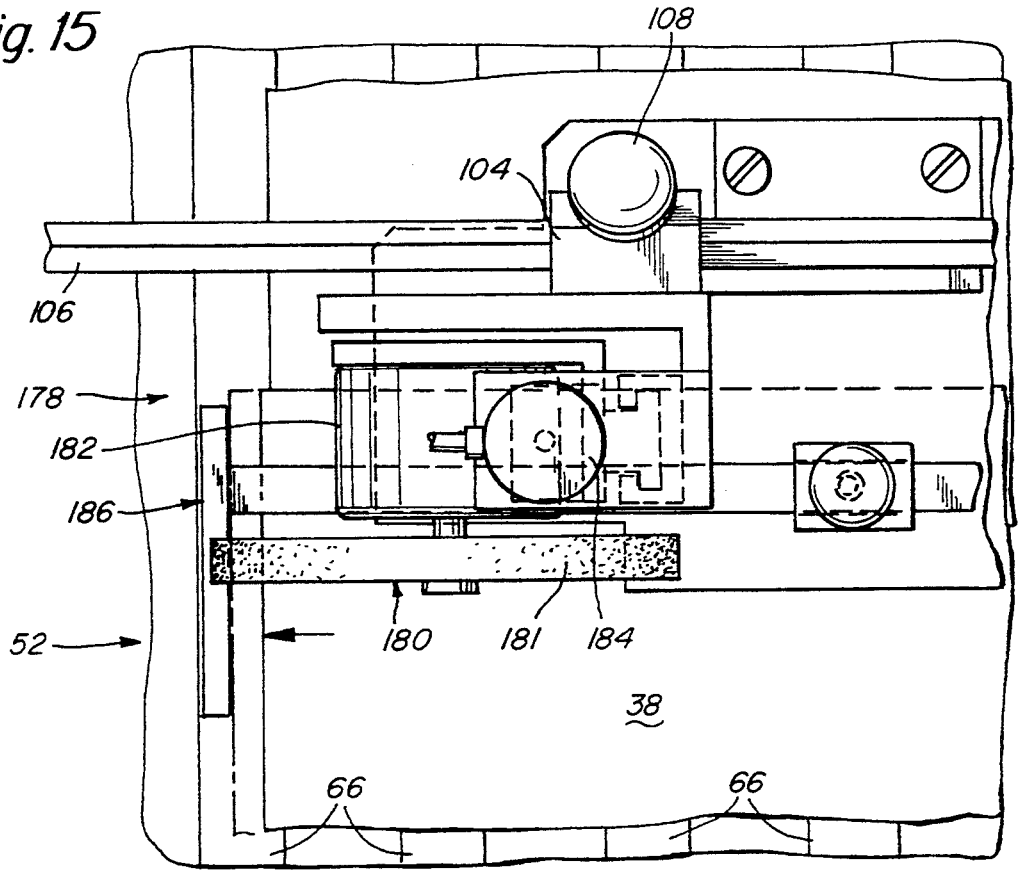
FIG. 15 is a somewhat schematic top view of the sheet kicker mechanism of FIG. 14.

FIGS. 14 and 15 illustrate yet another alternative embodiment for a kicker mechanism 178 according to this invention. The kicker mechanism 178 according to this embodiment utilizes a wheel 180 covered with an elastomeric material 181 that is brought into contact with underlying sheets 38 with predetermined pressure. The wheel 180 may be powered by a rotary solenoid, standard electric motor, servo motor, stepper motor or similar driving motor 182 for generating rotational motion. The wheel 180 according to this embodiment is brought into and out of engaging contact with each sheet 38 by means of a linear motor 184 that raises and lowers the wheel 180 and its driving motor 182.

The wheel 180 according to this embodiment is positioned at a point on the sheet that balances the upstream and downstream frictional resistance to sideways motion in a manner similar to the FIG. 1 kicker foot embodiment. Unlike the depicted embodiments utilizing a foot, however, the wheel 180 according to this embodiment may be driven by a continuously rotating motor 182 that generates rotational force throughout its engagement with the sheet 38. Sideways limiting of sheet offset may be accomplished by means of an adjustable stop 186 that prevents further sideways translation of a kicked sheet driven by the motor 182.

The motor 182 may include a clutch (not shown) that allows rotation to cease given a certain resistance generated by the sheet 38 engaging the stop 186. Alternatively, sideways sheet translation may be limited by providing a continually rotating wheel that is brought into engagement with the sheet by the linear motor 184 only for a specifically metered time interval. In other words, the motor 184 would cause the wheel 180 to engage and withdraw from the sheet 38 such that the interval of engagement equals a time sufficient to allow the sheet 38, given a certain wheel velocity of rotation, to translate a specific sideways distance. In practice, such an arrangement may prove overly complex.

Thus, a kicker mechanism having no stops and a wheel 180 may be implemented by providing a stepper or servo motor that rotates the wheel only through a certain number of degrees. In this manner, each sheet will be translated to the side by a metered distance without the use of stops. The linear motor 184 may then engage the wheel 180 with the sheet 38 and withdraw the wheel from the sheet at any time that the sheet 38 is positioned stationarily relative thereto. The linear motor 184 must only maintain the wheel 180 in engagement with the sheet 38 while the metered rotation occurs.

Figure 16:
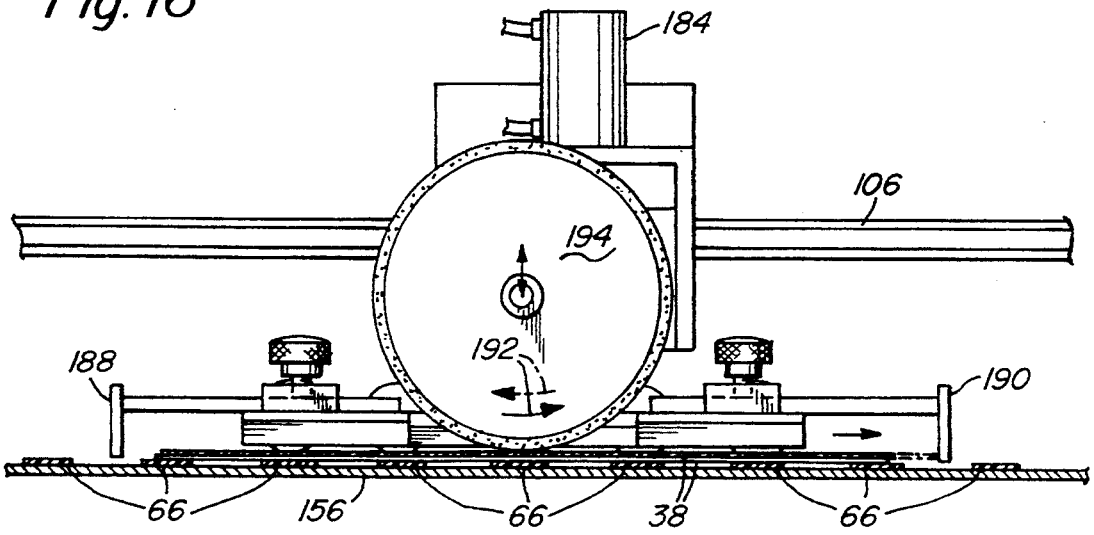
FIG. 16 is a somewhat schematic front view of an alternative embodiment of the sheet kicker mechanism of FIG. 14 showing bidirectional kicking of sheets.
Figure 17:
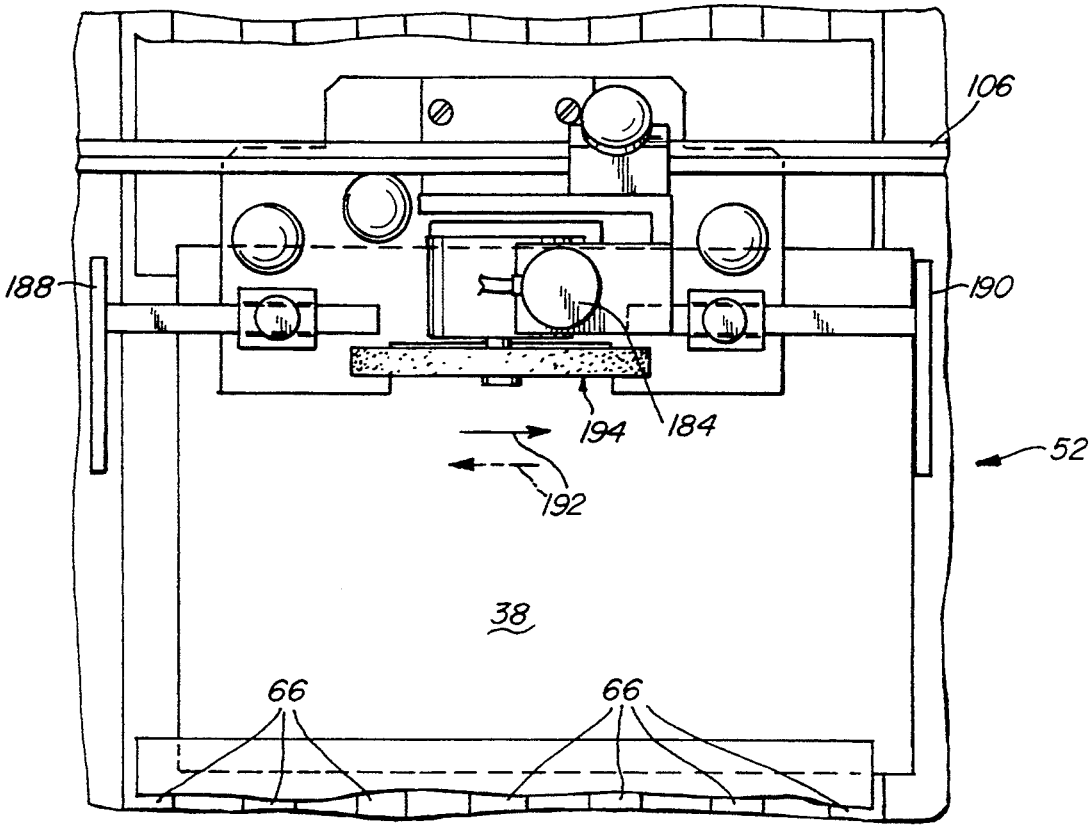
FIG. 17 is a somewhat schematic top view of the sheet kicker mechanism of FIG. 16.

An advantage to a kicker wheel 180 as depicted in FIGS. 14 and 15 is that it enables multidirectional translation of a sheet on demand. FIGS. 16 and 17 depict an alternative wheel kicker embodiment wherein two pairs of stops 188, 190, on opposite sides of the sheet are employed. Hence, by controlling the direction of rotation (arrows 192) of the kicker wheel 194, a sheet can be selectively translated either to the left or to the right by a predetermined offset distance.

Figure 11A:
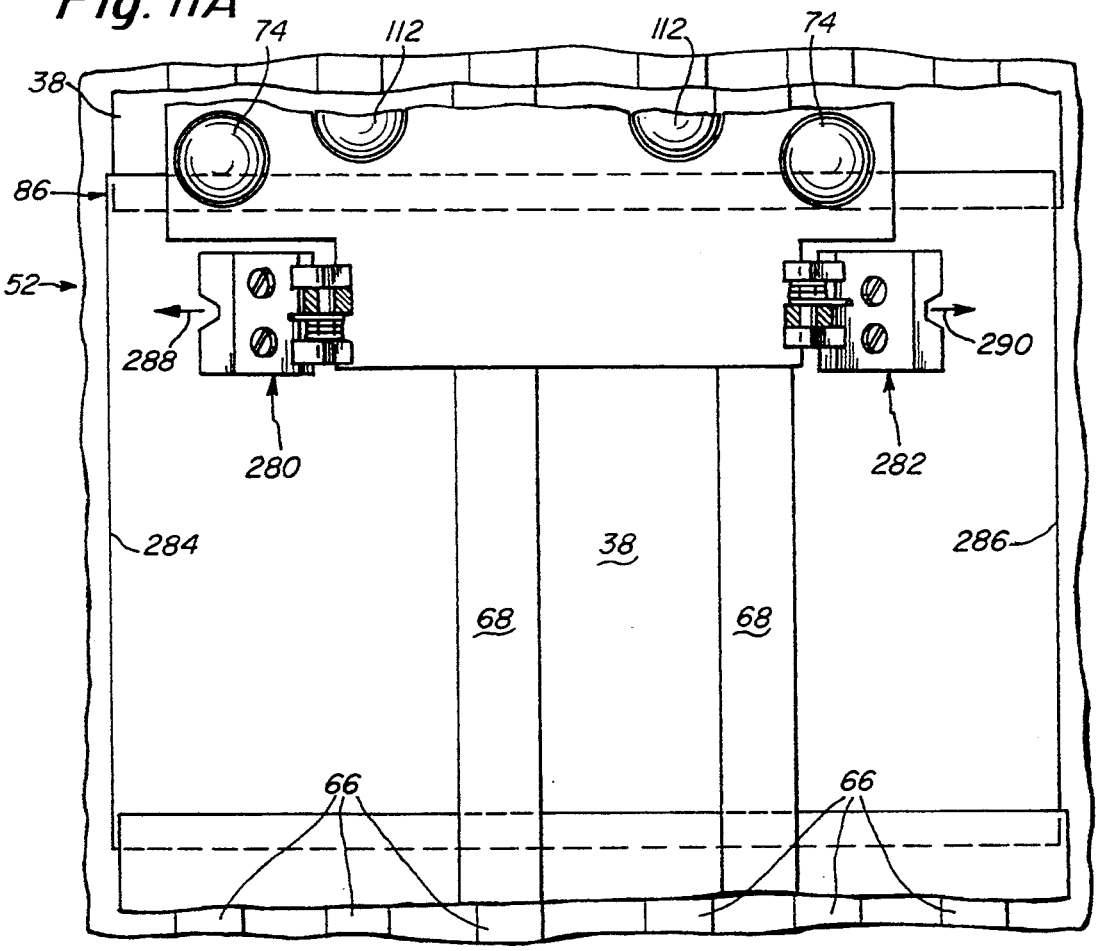
FIG. 11A is a schematic top view of an alternative embodiment of a sheet kicker mechanism according to this invention.

Alternatively, as depicted in FIG. 11A, left and right kicking can be accomplished by means of a pair of feet 280 and 282 positioned at opposing side edges 284 and 286, respectively of the sheet that move in the direction of respective arrows 288 and 290 to offset sheets, or by means of a foot mechanism that alternates between a left facing and right facing orientation (not shown).

Note that the offset distance can be controlled to allow variable offset of sheets in a stack. The ability to vary the offset distance makes possible the delineation of the stack into various sections and subsections corresponding to varying offset sheets. The varying of offset distance can be controlled by means of the CPU 46 (FIG. 1). The CPU command the variation of the kicker foot stroke or wheel rotation. Similarly, motors (not shown) can be provided to move sheet edge stops. These motors may receive control commands from the CPU 46.

While varying offset distance may be accomplished by varying the stroke of a kicker foot or rotational angle of a kicker wheel, it is equally possible in embodiments utilizing a kicker foot to vary the offset of sheets by firing the kicker a multiplicity of times while the sheet is positioned relative thereto. In this manner, incremental variation in sheet offset. As such, a large offset, indicating for example a job separation, may be created by firing the kicker foot three times while a subsection marker may be generated by firing the kicker only once, thus forming a correspondingly small offset. While the controlling of offset distance in this manner makes possible, generally, incremental offset sizes, and does not require complex adjustment of kicker stroke. Rather, each incremental offset will have the same metered distance and very accurate control of offset distance is possible.

Figure 18:
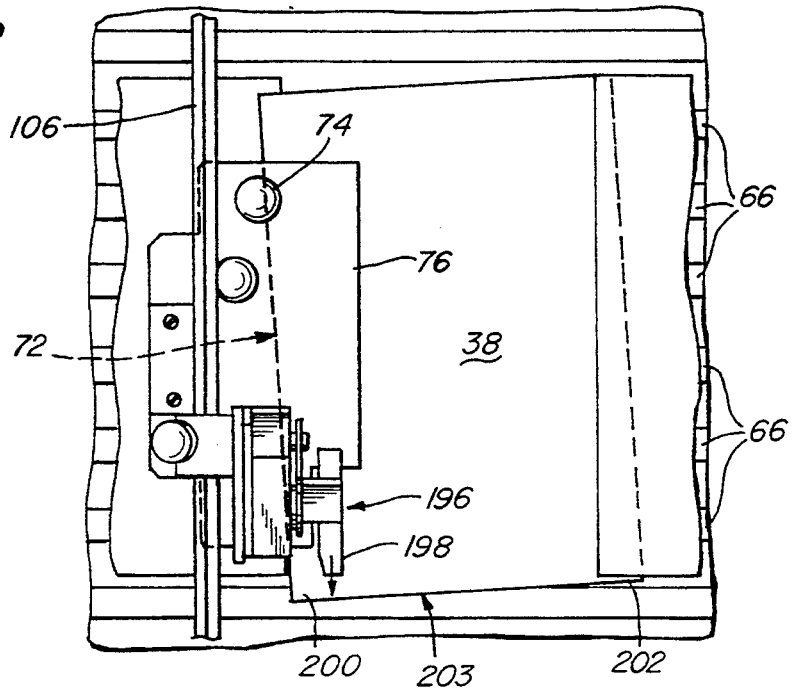
FIG. 18 is a somewhat schematic top view of an alternative embodiment of a sheet kicker mechanism for producing angled offset tab sheets according to this invention.
Figure 19:
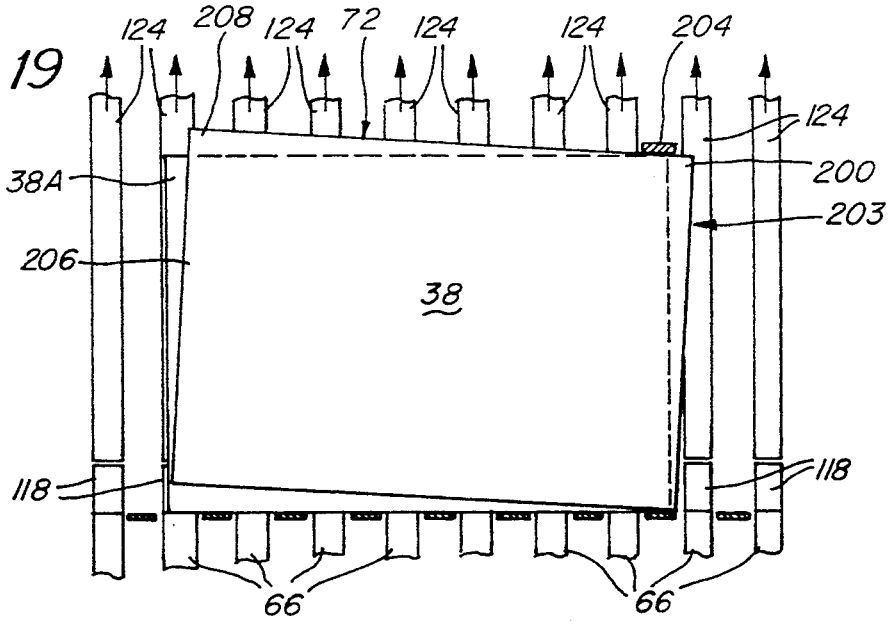
FIG. 19 is a somewhat schematic rear view of the formation of a stack including angled offset tab sheets according to this invention.
Figure 20:
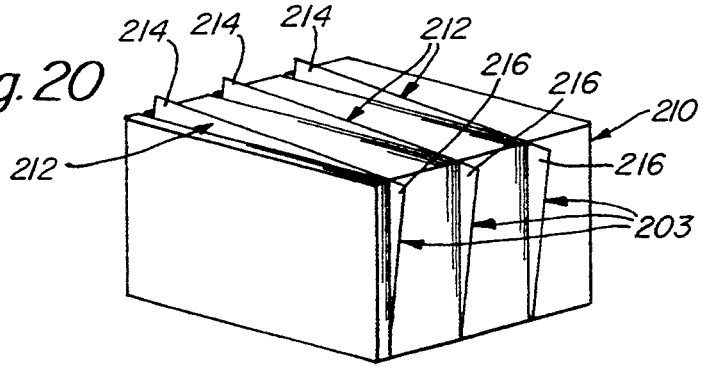
FIG. 20 is a schematic perspective view of a stack including angular offset tab sheets for separating section therein.

An alternative method of forming offset tab sheets according to this invention is depicted in FIGS. 18–20. In FIG. 18, a sheet 38 is positioned relative to the kicking mechanism 196 so that the narrow foot 198 (or other kicking device according to this invention) causes an off balanced translation of the sheet 38. Thus, as the sheet 38 is translated sideways, the corner 200 closest to the kicking mechanism foot 198 moves further than the more upstream corner 202. Hence, the sheet 38 appears crooked relative to other sheets in the stream with one corner projecting outwardly from the side. Such an offset may be accomplished by placing the kicker foot very close to one of either the upstream or downstream edge, or by decreasing the weight of the balls 74 that contact the sheet leading edge 72 and, hence, reducing the frictional resistance of this edge relative to the upstream trailing edge of this sheet 38.

As the sheet 38 is moved along the conveyor 66 following the formation of an angular offset 203 in FIG. 18, it enters the vertical stacking mechanism belts 124 with this angular offset as depicted in FIG. 19. The top edge stop 204 according to this embodiment must not interfere with the top (leading) edge 72 of the sheet 38 on the side 206 opposite the offset 203. Hence, a stop 204 is only provided for the stack, in this embodiment, proximate the offset side 203. As such, an upward projection of the sheet corner 208 may occur on the opposing side 206. It may be possible, according to this invention, to provide a second stop (not shown) at a point beyond (to the left of) the projecting offset top edge corner 208 of the sheet 38 to maintain the remaining offset sheets 38A in the stack in an appropriate position.

A stack 210 having angular offset tab sheets 212 according to this embodiment is depicted in FIG. 20. It is possible to place marking information on either the offset upper 214 or offset side edge 216 of the offset sheets in order to identify the contents of a section bounded by a particular offset sheet. In fact, according to this invention two different classes of information (such as volume and section number) may be placed on each of the offset edges 214,216. As in other embodiments discussed above, it is possible to create sheet offsets in each of opposing directions so that the stack includes offsets both to the left and right side thereof.

The stacking unit 44 according to this embodiment is sufficiently wide through its trough section and stacking mechanism section to accommodate any conventional web width, including double standard width webs. It is, hence, possible according to this embodiment to adapt the stacking unit 44 to simultaneously offset and stack two streams of sheets running simultaneously aside one another.

Figure 21:
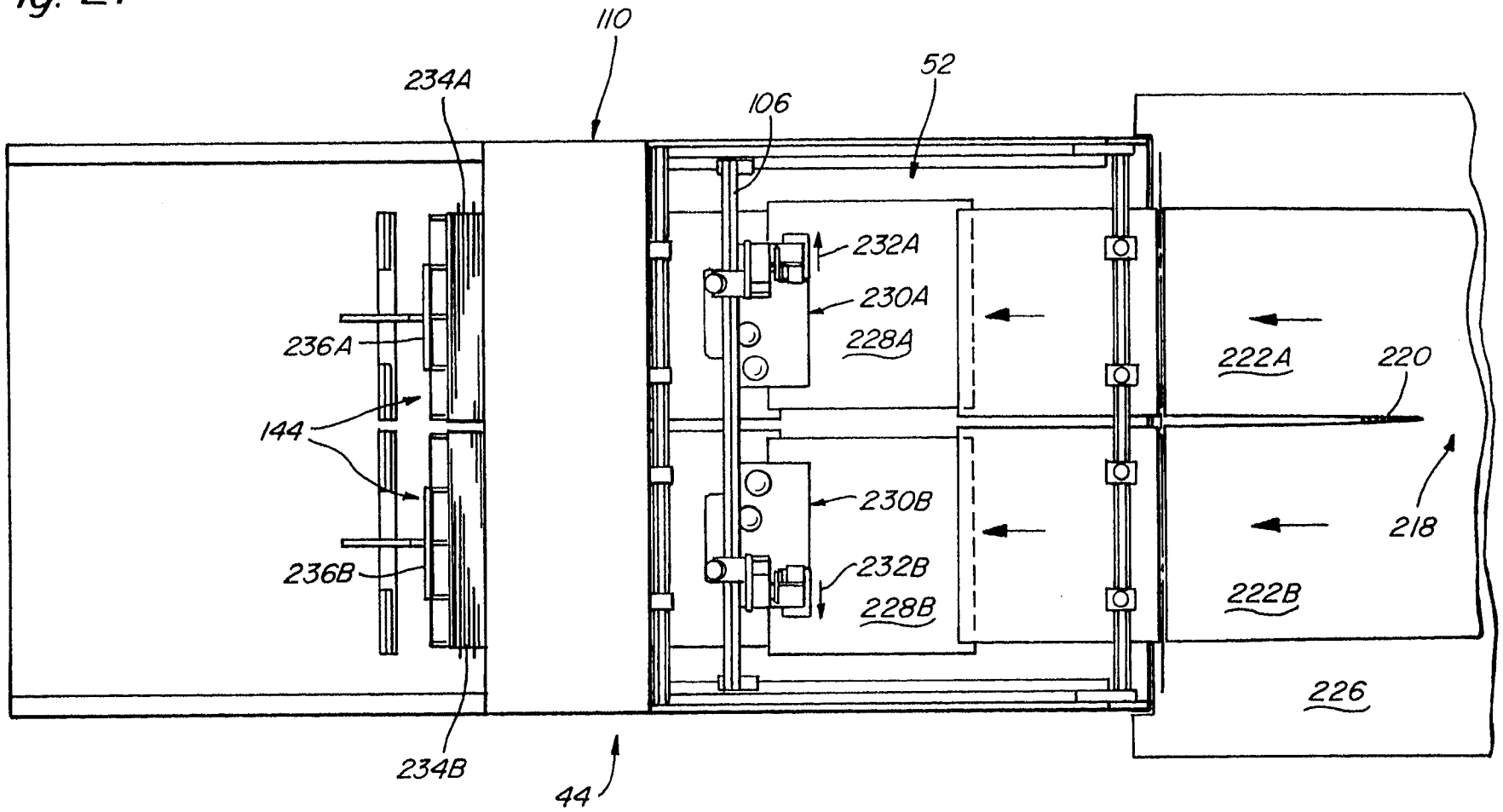
FIG. 21 is a somewhat schematic top view of an alternative embodiment including a pair of sheet kicker mechanisms for directing sheets from each of a pair of slit webs in opposite offset directions for forming two tabbed stacks.

FIG. 21 depicts an embodiment in which a single wide web 218 is slit by a blade 220 into two narrower side-by-side webs 222A and 222B by the cutting unit 226. Each sheet 228A and 228B is then, subsequently, cut from each of the slit webs 222A and 222B by the cutting unit 226 as it enters the trough conveyor section 52 of the stacking unit 44. Each sheet 228A, 228B is presented to a respective kicking mechanism 230A, 230B positioned relative to each of the streams of sheets which, on command, kicks selected sheets to each of opposing sides (arrows 232A and 232B). In this embodiment, each kicking mechanism 230A and 230B translates a respective sheet 222A and 222B in an opposite direction in order to prevent entanglement of one offset sheet with another. Given sufficient clearance between streams of side-by-side sheets, it is possible to kick both of the side-by-side sheets in the same direction.

Following passage through each kicking mechanism 230A, 230B and translation to the side, if any, each sheet 222A, 222B passes into the stacking mechanism 110 where it is formed into a respective side-by-side stack 234A, 234B. The backing rail assembly 144 in fact comprises a pair of individual side-by-side backing rails 236A, 236B for each respective stack. Since the conveyor belts of the conveyor section 52 and stacking mechanism 110, as discussed above, include no obstructions along their width, it is relatively straightforward to adapt the stacking unit 44 according to this invention to drive two or more side-by-side streams of sheets (see FIGS. 3 and 9). The number of streams of sheets is limited only by the width of the conveyor belt arrangement and the number of dedicated kicking mechanisms. The CPU 46 (FIG. 1) may be programmed to recognize commands relative to each separate stream of sheets so that the timing and magnitude kicking commands and size parameters for each different stream may be varied individually.

Figure 22:
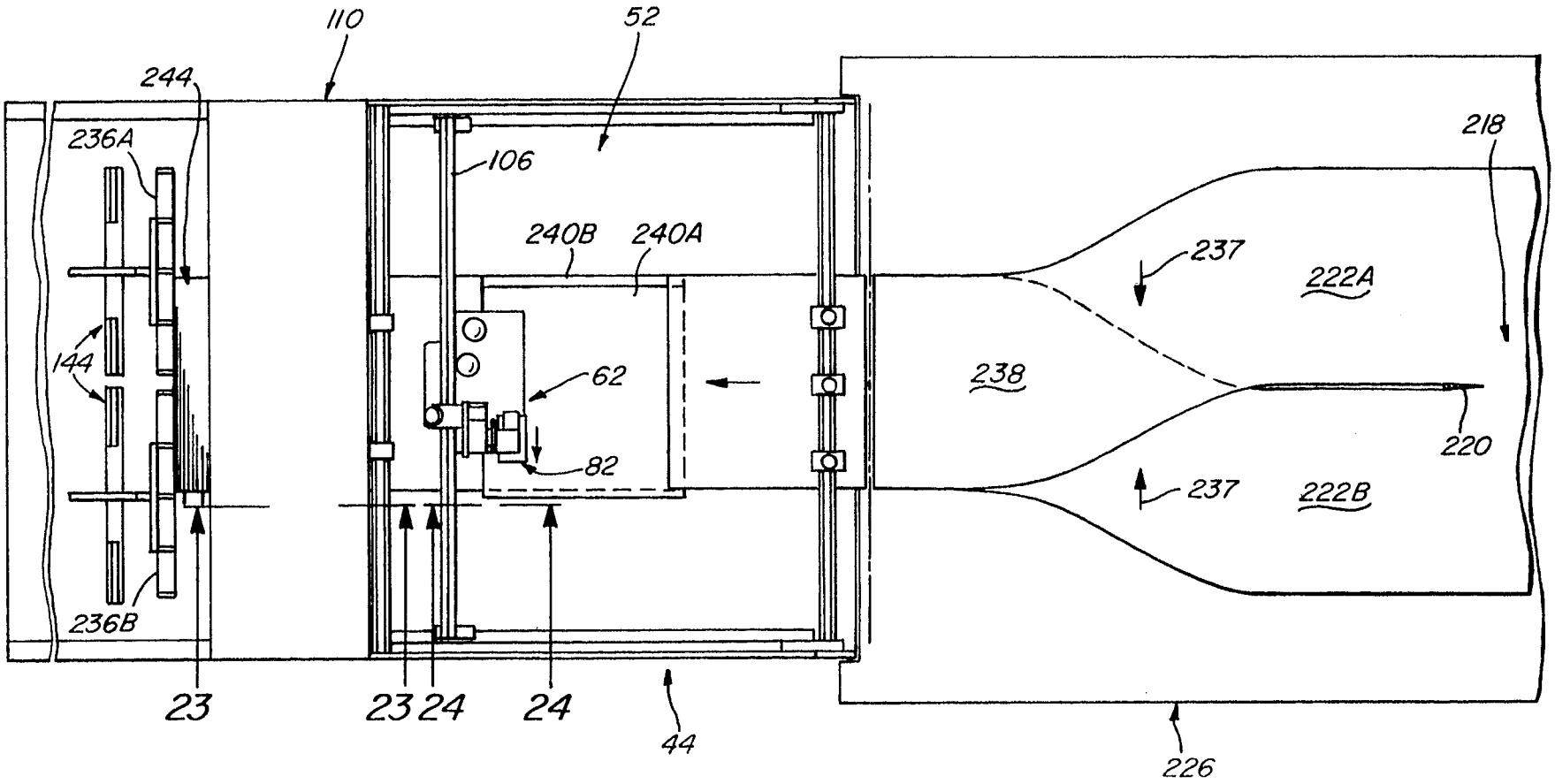
FIG. 22 is a schematic top view of a web stacker and separator according to this invention utilizing sheets from a slit and merged web.

In another alternative embodiment depicted in FIG. 22, a wide web is slit as in the embodiment of FIG. 21 to form two side-by-side narrower webs 222A and 222B. In this embodiment, the narrower webs are usually substantially equal in width. The two slit webs 222A and 222B are then merged (arrows 237) by means of directors (not shown) into a single stream 238 comprising the two overlaid webs 222A and 222B. The overlaid webs are then simultaneously cut into individual double sheets 240A and 240B of preprogrammed size by the cutting unit 226 prior to their entry onto the conveyor belts 66 of the stacking unit trough.

The sheets 240A, 240B proceed, overlaying each other, down the trough to the kicker mechanism 62. The mechanism is similar to that of FIG. 1 except that it has been centered in the trough. They are held stationarily relative to the kicker mechanism by a stopping of the drive motor as the CPU determines whether to issue a kick command to the kicker mechanism for the underlying sheets. If so, the upper of the two sheets 240A in the overlaid pair is translated to the side to form an offset tab sheet. Note that, since the bottom sheet 240B displays substantially the same frictional resistance to the upper sheet as a single kicked sheet 38 experiences in the FIG. 1 embodiment, the upper sheet 240A still translates relative to the bottom sheet 240B and relative to other upstream and downstream sheets in the stream without any associated movement of these other sheets.

In general, the kicker mechanism foot 82 may be maintained at a position relative to the sheet 240A similar to that for a single, non-overlaid, sheet embodiment. However, any changes in friction that may result in angular offset of this sheet as it is translated sideways, may be accounted for by adjusting the positioning of the sheet relative to the kicker foot 82 until the proper frictional force balance is achieved. As noted, this adjustment may be accomplished by altering the upstream/downstream location of the kicker mechanism, or, for example, by altering the angle of attack of the foot or by altering the foot actuator's power.

Figure 23:
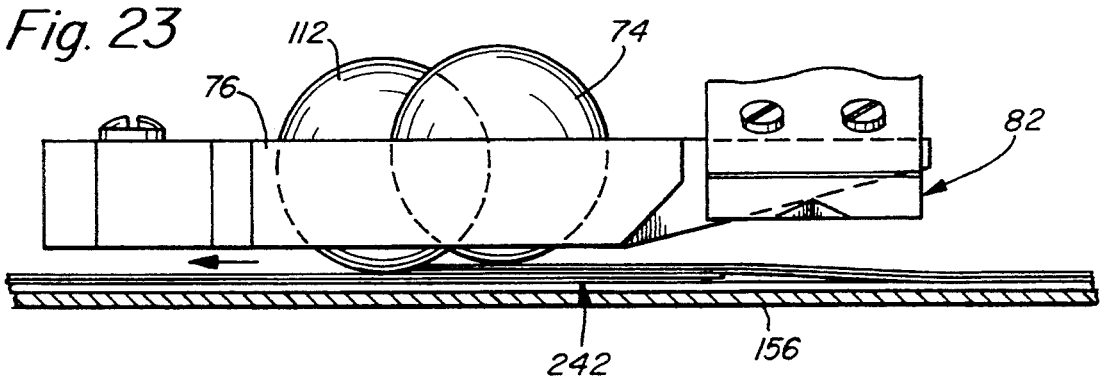
FIG. 23 is a somewhat schematic side view detailing the feeding of merged sheets taken along the line 23—23 of FIG. 22.

FIG. 23 further illustrates a side view of the feeding of overlaid sheets through the kicker mechanism 62. Note that the ball bearing rollers 74, since they are free to move vertically for a certain distance, allow many layers (four in this example) of sheets in the area of overlap 242 to pass therethrough.

Figure 24:
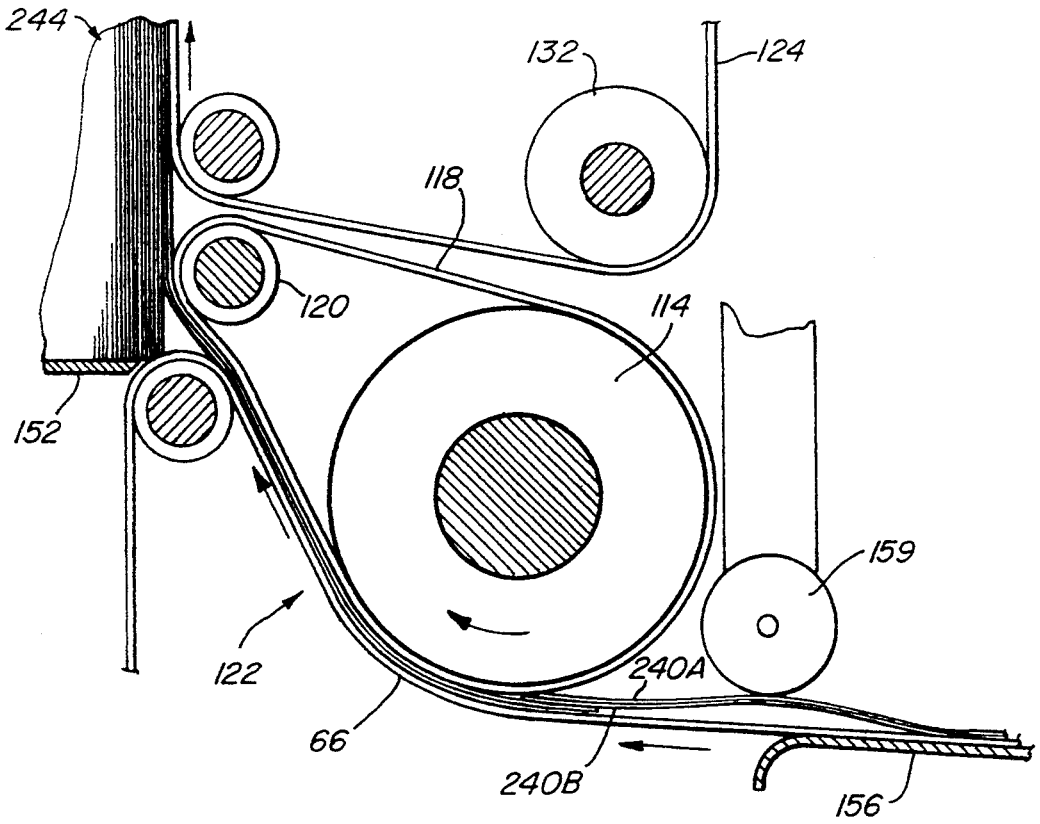
FIG. 24 is a more detailed partial side view of the stack forming mechanism taken along line 24—24 of FIG. 22 detailing the forming of a stack using merged sheet pairs.

Following movement of the sheets through the kicker mechanism 62, the sheets continue along the conveyor section 52 into the stacking mechanism 110. Since the intermeshing belts 66 and 118 each move simultaneously, each belt bears upon one of the two overlaid sheets and friction between the sheets 240A, 240B maintains them in a stationary position relative to each other. The sheets, hence, enter the stack 244 as an overlapping pair. This process is illustrated in detail in FIG. 24.

Figure 25:
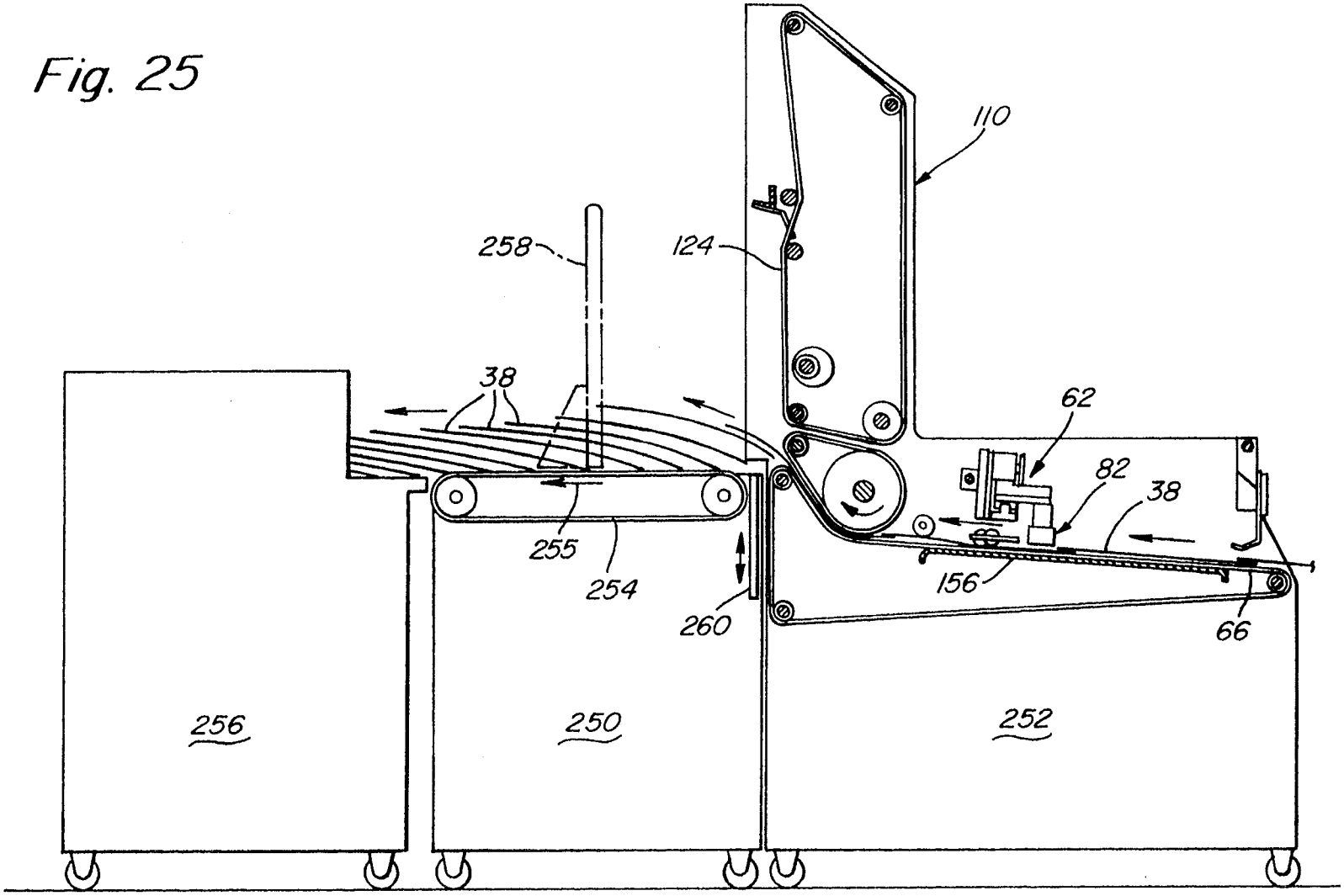
FIG. 25 is a schematic side view of an alternative embodiment of a web stacker and separator particularly adapted for feeding offset sheets to a modular stack support stand which can be adapted to transmit directly from a conveyor to a utilization device such as a printer.

In the above-described embodiment, the conveyor 52 and stacking mechanism 110 are fixedly interconnected with the stack forming table 152. However, it is contemplated according to this invention that the forming table may comprise a separate module. FIG. 25 shows a forming table module 250 that is positioned adjacent a stand alone conveying and stacking module 252. In the specific embodiment shown, a forming table belt 254 is driven (arrow 255) to provide a cascading stream of overlapping sheets directly from the stacker to a utilization device 256 such as a printer.

It is also contemplated according to the embodiment of FIG. 25 to provide a set of backing rails or stops 258 (shown in phantom) according to this invention to allow the formation of a conventional horizontal stack as described herein. The entire table 250 could, subsequent to stack formation, be unlocked from the conveying and stacking module 252 and moved to another location to feed of the formed stack on the table 250 to a separate remote utilization device 256. To facilitate adequate support of a horizontal stack on the table 250, a second guard 260 is positioned proximate the upstream side of the module 250. This guard is raised into position before movement of the module 250 away from the stacking mechanism forming belt 124. In this manner, a fully contained horizontal stack is maintained.

Figure 26:
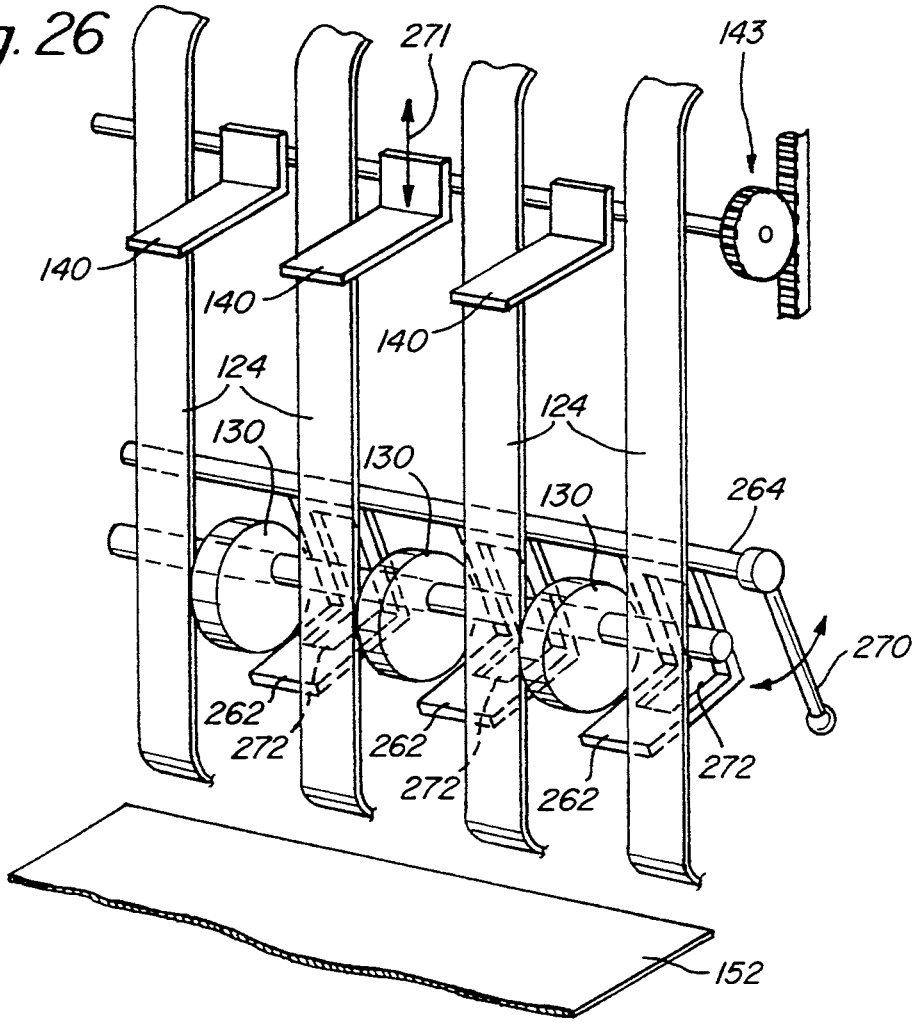
FIG. 26 is a schematic perspective view of a further improvement to the stacking mechanism according to this invention including a second retractable set of top stops.
Figure 27:
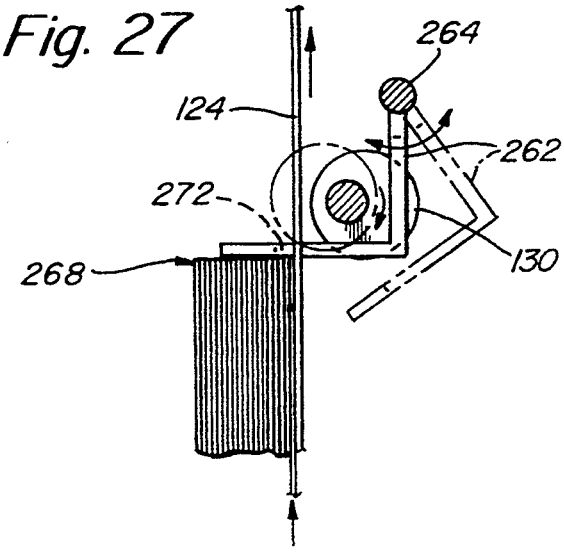
FIG. 27 is a schematic side view of the retractable top stops of FIG. 26 shown in both an extended and retracted (phantom) position.

FIGS. 26 and 27 depict an additional improvement to the stacking mechanism arrangement according to this invention. The top stops 140 are, as noted above, movable in a vertical direction (arrow 271) in order to accommodate variable size stacks. For half-size sheets, however, it may be desirable to provide a second set of retractable stops 262. The stops 262 are mounted on an axle 264 and are brought into and out of engagement with the top of a stack 268 (FIG. 27) by means of a lever 270. In a retracted position (shown in phantom in FIG. 27) the stops 262 are fully disengaged interfering contact with vertically driven sheets rising on the belts 124. Thus, the sheets are free to travel fully upwardly to the top stops 140.

The stops 262 are contemplated according to this embodiment as positioned at a point along the stacking mechanism that is on a level with the cam arrangement 130. Such small sheets generally do not require a cam 130 to provide spacing of the stack from vertically driven sheets since shorter sheets have less tendency to buckle and bind upon the surface of adjacent sheets in the stack. Hence, each of the stops 262 includes a slot 272 into which a corresponding cam 130 seats. The stops, thus, do not interfere with the motion of the cams, but effectively cover them.

The following has been a detailed description of several embodiments of the invention. Various modifications, additions and deletions are possible according to this invention without departing from its spirit and scope. The foregoing, therefore, is meant to be taken only as some possible embodiments, and to be taken by way of example and not to, otherwise, limit the scope of the invention. Rather, the scope of the invention should be determined only by the following claims.

What is claimed is:

1. An apparatus for stacking and separating sheets comprising:

conveyor means that transports sheets from a source in a first orientation in a stream aligned in a downstream direction to a stacking location, the conveyor means including a table that supports the sheets thereon as they are transported in the downstream direction;

kicker means located along the conveyor means that offsets selected of the sheets in a direction substantially transverse to the downstream direction, the kicker means including a reciprocating member having a frictional surface that engages and withdraws from each of the selected sheets to drive the selected sheets transverse to the downstream direction into an offset position;

stacking means positioned at the stacking location that receives each of the sheets from the first orientation in the conveyor means and overlays each of the sheets in a second orientation in a stack extending downstream; and a weighted roller located on a face of each of the sheets opposite a face of each of the sheets that faces the table, the kicker means being located remote from the weighted roller and the roller being constructed and arranged so that it enables movement of each of the sheets in each of the downstream direction and a direction transverse to the downstream direction.

2. The apparatus as set forth in claim 1 further comprising a drive motor interconnected to the conveyor means.

3. The apparatus as set forth in claim 2 further comprising central processor means for controlling each of the conveyor means and kicker means.

4. The apparatus as set forth in claim 3 wherein the central processor means includes controller means for intermittently operating the drive motor to position each of the sheets stationarily relative to the kicker means.

5. The apparatus as set forth in claim 1 wherein the stacking means comprises a plurality of diagonally disposed conveyor belts interengaging the conveyor means and moving simultaneously with the conveyor means, the diagonally disposed conveyor belts driving each of the sheets from a horizontal to a vertical orientation.

6. The apparatus as set forth in claim 5 wherein the stacking means further comprises a plurality of vertically disposed conveyor belts positioned above and downstream of the diagonally disposed conveyor belts for driving each sheet into a vertical orientation to form a horizontally disposed stack.

7. The apparatus as set forth in claim 6 wherein the stacking means further comprises a moving surface that spaces sheets of the horizontally oriented stack away from the vertically disposed conveyor belts as each sheet passes from the diagonally disposed conveyor belts to the vertically disposed belts.

8. The apparatus as set forth in claim 1 wherein the kicker means enables offset of sheets in each of opposite transverse directions to the downstream direction.

9. The apparatus as set forth in claim 1 wherein the source of sheets includes a cutter that cuts each of the sheets from a continuous web.

10. The apparatus as set forth in claim 1 wherein the first orientation comprises a substantially horizontal orientation and wherein the second orientation comprises a substantially vertical orientation.

11. An apparatus for stacking and separating sheets comprising:

conveyor means for transporting sheets from a source in a first orientation in a stream aligned in a downstream direction to a stacking location;

kicker means located along the conveyor means that offsets selected of the sheets in a direction substantially transverse to the downstream direction, the kicker means including a reciprocating foot having a frictional surface that engages and withdraws from each of the selected sheets to drive the selected sheets into an offset position transverse to the downstream direction, the kicker means further including a slide having a carriage with the foot mounted thereto, the slide being oriented at a downward angle so that the foot engages each sheet at an angle; and stacking means positioned at the stacking location that receives each of the sheets from the first orientation in the conveyor means and overlays each of the sheets in a second orientation in a stack extending downstream.

12. The apparatus as set forth in claim 11 wherein the foot includes a pivot and a spring positioned relative to the carriage that allows the foot to position upwardly as the carriage is driven downwardly to engage each selected sheet along the slide, the spring maintaining a biasing pressure of the foot against the sheet.

13. An apparatus for stacking and separating sheets comprising:

conveyor means that transports sheets from a source in a first orientation in a stream aligned in a downstream direction to a stacking location;

a drive motor interconnected to the conveyor means;

kicker means located along the conveyor means for offsetting selected of the sheets in a direction substantially transverse to the downstream direction;

stacking means positioned at the stacking location that receives each of the selected sheets from the first orientation in the conveyor means and overlays each of the selected sheets in a second orientation in a stack extending downstream; and central processor means that controls each of the conveyor and the kicker means, the central processor means including controller means that intermittently operates the conveyor means to position each of the selected sheets stationarily relative to the kicker means and the central processor means further including means for determining input sheet size to vary timing of the intermittent operation of the drive motor.

14. The apparatus as set forth in claim 13 wherein the central processor means includes means for identifying specific sheets to be offset by the kicker means.

15. An apparatus for stacking and separating sheets comprising:

conveyor means that transports sheets from a source in a first orientation in a stream aligned in a downstream direction to a stacking location;

kicker means located along the conveyor means that offsets selected of the sheets in a direction substantially transverse to the downstream direction, the kicker means including a reciprocating member having a frictional surface that engages and withdraws from each of the selected sheets to drive the selected sheets transverse to the downstream direction into an offset position, the kicker means including a pair of weighted multidirectional roller means for engaging and maintaining stationary against a conveyor means a leading edge of each of the sheets as it is positioned relative to the kicker means; and stacking means positioned at the stacking location that receives each of the sheets from the first orientation in the conveyor means and overlays each of the sheets in a second orientation in a stack extending downstream.

16. An apparatus for stacking and separating sheets comprising:

conveyor means that transports sheets from a source in a stream aligned in a downstream direction to a stacking location;

kicker means located along the conveyor means that offset selected of the sheets in a direction substantially transverse to the downstream direction, the kicker means including a pair of multidirectionally movable weighted balls that engage and maintain a leading edge of each of the sheets stationarily against the conveyor means as the sheets are positioned relative to the kicker means, the weighted balls each being positioned within an orifice of a plate, the balls being located over each of the sheets when the sheets are each positioned relative to the kicker means; and stacking means positioned at the stacking location that receives each of the sheets from the first orientation in the conveyor means and overlays each of the sheets in a second orientation in a stack extending downstream.

17. An apparatus for stacking and separating sheets comprising:

conveyor means that transports sheets from a source in a stream aligned in a downstream direction in a first orientation to a stacking location;

kicker means located along the conveyor means that offsets selected of the sheets in a direction substantially transverse to the downstream direction; and stacking means positioned at the stacking location that receives each of the sheets from the first orientation in the conveyor means and overlays each of the sheets in a second orientation in a stack extending downstream, the stacking means comprising a plurality of diagonally disposed conveyor belts interengaging the conveyor means, the diagonally disposed conveyor belts driving each of the sheets from a horizontal to a vertical orientation and the stacking means further comprising a plurality of vertically disposed conveyor belts positioned above and downstream of the diagonally disposed conveyor belts for driving each sheet into a vertical orientation to form a horizontally disposed stack, the stacking means including a moving surface for spacing sheets in the horizontally oriented stack away from the vertically disposed conveyor belts as each of the sheets passes from the diagonally disposed conveyor belts to the vertically disposed conveyor belts and the reciprocating surface being mechanically interconnected to operate simultaneously and each of the vertically disposed conveyor belts and the reciprocating surface being mechanically interconnected to the diagonally disposed conveyor belts to operate at a different rate than the diagonally disposed conveyor belts.

18. The apparatus as set forth in claim 17 wherein the stacking means further comprises a movable stack support means for maintaining an end of the stack opposite the vertically disposed belts in a vertical orientation.

19. The apparatus as set forth in claim 18 wherein the movable stack support includes a base for contacting a friction means for providing resistance to downstream movement and wherein the base further includes a constant tension spring means for providing a preset force to the end of the stack, the force of the constant tension spring means being overcome by the reciprocating surface means.

20. The apparatus as set forth in claim 17 wherein the stacking means includes a stacking conveyor and further comprising a plurality of rotating cams constructed and arranged to space the stack away from the stacking conveyor as each of the sheets are driven into the stack in the second orientation.

21. An apparatus for stacking and separating sheets comprising:

conveyor means that transports sheets from a source in a first orientation in a stream aligned in a downstream direction to a stacking location, the conveyor means including a conveyor table that supports the sheets thereon;

kicker means located along the conveyor means adjacent a face of each of the sheets opposite a face that engages the table, that offsets selected of the sheets in a direction substantially transverse to the downstream direction;

stacking means positioned at the stacking location that receives each of the sheets from the first orientation in the conveyor means and overlays each of the sheets in a stack extending downstream in a second orientation; and wherein the conveyor means receives a plurality of side-by-side streams of sheets and the kicker means includes a plurality of individually operated sheet-engaging kicker feet for offsetting selected of each of the streams in a direction transverse to the downstream direction each of the kicker feet engaging the face of the selected sheets and moving in the transverse direction to slide the selected sheets transversely along the table.

22. An apparatus for stacking and separating sheets comprising:

conveyor means that transports sheets from a source in a first orientation in a stream aligned in a downstream direction to a stacking location, the conveyor means including a table that supports sheets thereon;

kicker means located along the conveyor means, the kicker means positioned above each of the sheets and the table, that offsets selected of the sheets in a direction unaligned with the downstream direction, the kicker means including a sheet-engaging kicker foot positioned to engage each of the selected sheets positioned relative thereto at a point in which sheet frictional resistance forces between the selected sheets and the table upstream of the foot are unequal to sheet frictional resistance forces between each of the selected sheets and the table downstream of the foot so that each of the selected sheets is translated unevenly, having an angular offset, in a direction unaligned with the downstream direction; and stacking means positioned at the stacking location that receives each of the sheets from the first orientation in the conveyor means and overlays each of the sheets in a second orientation in a stack extending downstream including vertically positioned stack forming stops that allow the formation of the stacks with angularly-offset sheets positioned therein.

23. A method of stacking and separating sheets comprising the steps of:

providing a plurality of sheets from a source;

conveying each of the sheets in a downstream direction in a first orientation to a stacking location;

locating each of the sheet upstream of the stacking location at an offset station and translating selected stationarily positioned sheets in a direction substantially coplanar with and transverse to the downstream direction to form an offset in the selected sheets relative to other of the sheets, the step of translating including engaging the selected sheets with a reciprocating surface that grips the sheets to move the sheets in a transverse direction; and the step of translating further including engaging an upstream edge of the selected sheets with a weight that enables movement of the sheets in each of the downstream direction and a direction transverse to the downstream direction; and forming each of the sheets at the stacking location into a stack with each sheet oriented in a second orientation.

24. A method as set forth in claim 23 wherein the step of providing includes cutting each of the plurality of sheets from a continuous web.

25. A method as set forth in claim 23 wherein the step of stacking comprises directing each sheet from the offset location through a substantially diagonal conveyor and then into a vertical conveyor wherein a horizontal stack is formed.

26. A method as set forth in claim 25 further comprising spacing the horizontal stack away from the vertical conveyor at selected intervals that allow additional sheets to be driven into the stack via the vertical conveyor.

27. A method as set forth in claim 25 further comprising supporting of the stack at an end opposing the vertical conveyor, the supporting including providing frictional resistance to downstream expansion of the stack that is overcome by the step of spacing.

28. A method as set forth in claim 27 further comprising providing biasing force to the stack at the end opposing the vertical conveyor, the biasing force being overcome by the step of spacing.

29. A method as set forth in claim 23 wherein the first orientation comprises a substantially horizontal orientation and wherein the second orientation comprises a substantially vertical orientation.

30. A method of stacking and separating sheets comprising the steps of:

providing a plurality of sheets from a source;

supporting each of the sheets on a table and conveying each of the sheets on the table in a downstream direction in a first orientation to a stacking location;

locating each of the sheets upstream of the stacking location at an offset station and translating selected sheets in a direction substantially transverse to the downstream direction to form an offset in the selected sheets relative to other of the sheets, the step of translating including engaging each of the selected sheets while each of the sheets is positioned relative to the offset station with a moving foot that moves in the transverse direction from a position above and remote from the selected sheets to a position in frictional engagement with the selected sheets and that, in frictional engagement with the selected sheets, slides the selected sheets in the substantially transverse direction along the table, wherein the offset of the selected sheets is varied by engaging at least some of the selected sheets a plurality of times with the foot while the selected sheets are each positioned relative to the offset station; and forming each of the sheets at the stacking location into a stack with each of the sheets oriented in a second orientation.

31. A method of stacking and separating sheets comprising the steps of:

providing a plurality of sheets from a source;

supporting each of the sheets on a table and conveying each of the sheets on the table in a downstream direction in a first orientation to a stacking location;

locating each of the sheets upstream of the stacking location at an offset station and translating selected sheets in a direction substantially transverse to the downstream direction to form an offset in the selected sheets relative to other of the sheets, the step of translating including engaging each of the selected sheets while each of the sheets is positioned relative to the offset station with a moving foot that moves in the transverse direction from a position above and remote from the selected sheets to a position in frictional engagement with the selected sheets and that, in frictional engagement with the selected sheets, slides the selected sheets in the substantially transverse direction along the table, wherein the foot is positioned at a point of balance upon each of the selected sheets between upstream sheet frictional resistive forces and downstream sheet frictional resistive forces; and forming each of the sheets at the stacking location into a stack with each of the sheets oriented in a second orientation.

32. A method of stacking and separating sheets comprising the steps of:

providing a plurality of sheets from a source;

conveying each of the sheets in a downstream direction in a first orientation to a stacking location;

pausing each of the sheets upstream of the stacking location at an offset station and translating selected stationarily positioned sheets in a direction substantially transverse to the downstream direction to form an offset in the selected sheets relative to the other of the sheets, a leading edge of each of the sheets being held in the offset station by means of weighted balls that allow translation of the sheets in both a downstream direction and in a direction transverse to the downstream direction; and forming each of the sheets at the stacking location into a stack with each of the sheets oriented in a second orientation.

33. A method as set forth in claim 32 wherein each of the sheets moved in the downstream direction by the step of conveying overlaps and upstream of the sheets.

34. A method as set forth in claim 33 wherein each downstream of the sheets moved in the step of conveying overlaps an upstream of the sheets so that a spacing between leading edges of each of the sheets is approximately $1\frac{1}{2}$ inch.

35. An apparatus for stacking and separating sheets comprising:

a conveyor that transports sheets from a source in a stream aligned in a downstream direction to a stacking location;

a kicker located along the conveyor that offsets selected of the sheets in a direction substantially transverse to the downstream direction, the kicker including a reciprocating surface that grips and withdraws from the selected of the sheets to translate the selected of the sheets in the substantially transverse direction;

support means for supporting a downstream end of the stack, the support means including base means for engaging a means for resisting downstream movement of the stack, the base means being constructed and arranged to disengage from the means for resisting upon downstream movement of the support means;

a plurality of diagonally disposed conveyor belts interengaging the conveyor and moving simultaneously with the conveyor, the diagonally disposed conveyor belts driving each of the sheets from a horizontal to a vertical orientation, the sheets in the vertical orientation being stacked along a downstream direction; and a rotating eccentric cam for spacing the stack in a downstream direction from the diagonally disposed conveyor belts so that additional sheets can enter the stack.

36. The apparatus as set forth in claim 35 further comprising a constant tension spring that biases the support means into engagement with the downstream end of the stack.

37. An apparatus for separating sheets comprising:

a conveyor that transports sheets from a source in a stream aligned in a downstream direction to a stacking location;

a kicker located along the conveyor that offsets selected of the sheets in a direction substantially transverse to the downstream direction, the kicker including a reciprocating gripping surface that contacts and withdraws from the selected of the sheets to translate the selected of the sheets in the substantially transverse direction;

weighted movable rollers that engage a leading edge of each of the selected of the sheets when each of the selected of the sheets are positioned adjacent the kicker, the weighted movable rollers being mounted so that the rollers enable movement of the sheets in the downstream direction and in the direction substantially transverse to the downstream direction; and a guide, located downstream of the kicker that guides the sheets to a location remote from the kicker the guide being constructed and arranged to be positionable adjacent to a device for further processing of the sheets so that the sheets on the guide are input to the further processing device.

38. The apparatus as set forth in claim 37 wherein the guide includes a second conveyor that redirects the sheets from a first orientation at the kicker to a second orientation remote from and downstream of the kicker.

39. The apparatus as set forth in claim 38 wherein the first orientation comprises a substantially horizontal orientation.

40. The apparatus as set forth in claim 39 wherein the guide is constructed and arranged so that sheets moving therealong overlap each other.

41. The apparatus as set forth in claim 39 wherein the guide comprises a conveyor table having moving belts thereon for moving the sheets from the kicker to the further processing device.

42. The apparatus as set forth in claim 41 wherein the guide is constructed and arranged so that the guide is removable from the conveyor.

43. The apparatus as set forth in claim 42 wherein the guide further comprises wheels that allow movement of the guide independent of the conveyor.

44. The apparatus as set forth in claim 39 wherein the guide is constructed and arranged to maintain at least one of the sheets in a substantially vertical orientation that is substantially transverse to the horizontal orientation.

45. The apparatus as set forth in claim 37 wherein the guide comprises a conveyor table, the conveyor table having a guard located at an upstream end of the conveyor table, the guard being movable between an extended position wherein the guard prevents movement of sheets off of the table and a retracted position wherein sheets are movable from the conveyor and the kicker onto the table in a downstream direction.

46. An apparatus for stacking and separating sheets comprising:

a conveyor that transports sheets from a source in a first orientation in a stream aligned in a downstream direction to a stacking location, the conveyor including a table that supports the sheets thereon;

a kicker located along the conveyor, the kicker including a kicker surface positioned over each of the table and the sheets that engages predetermined sheets, the kicker surface moving from a position remote from the sheets in a direction aligned substantially transverse to the downstream direction and frictionally engaging and translating the predetermined sheets in a direction substantially transverse to the downstream direction the kicker surface sliding the sheets in the substantially transverse direction relative to the table;

a spring that biases the kicker surface toward the table to generate frictional contact with the predetermined sheets as the kicker surface frictionally engages the predetermined sheets; and a stacker, located downstream of the conveyor, that receives sheets from the conveyor and forms the sheets into a stack, the sheets being oriented in a second orientation.

47. An apparatus for stacking and separating sheets comprising:

a conveyor that transports sheets from a source in a first orientation in a stream aligned in a downstream direction to a stacking location, the conveyor including a table that supports the sheets thereon;

a kicker located along the conveyor that offsets predetermined sheets in a direction substantially transverse to the downstream direction, the kicker including a wheel having a frictional surface the wheel being located above each of the table and the sheets that engages and withdraws from the predetermined sheets at predetermined times, the wheel rotating through a predetermined arc when the wheel engages each of the predetermined sheets to translate the sheets into a substantially transverse direction, the axis of rotation of the wheel being aligned substantially parallel to the downstream direction; and a stacker, positioned at the stacking location, that receives each of the sheets from the conveyor and that overlays each of the sheets in a stack extending downstream, the sheets being oriented in a second orientation in the stack.

48. An apparatus for stacking and separating sheets comprising:

a conveyor that transports sheets from a source in a first orientation in a stream aligned in a downstream direction to a stacking location, the conveyor including a table that supports the sheets thereon;

a kicker, located along the conveyor at a position over each of the sheets and the table, that offsets predetermined sheets in a direction substantially transverse to the downstream direction, the kicker including a gripping wheel that moves from a position remote from each of the sheets and the table and that engages and withdraws from the predetermined sheets, the wheel rotating continuously during engagement with the predetermined sheets, the wheel having an axis of rotation substantially parallel to the downstream direction, the kicker further including a stop that limits offset of the sheets in the substantially transverse direction, the wheel constructed and arranged to allow slippage of the predetermined sheets relative to the wheel when the predetermined sheets contact the stop; and a stacker, positioned at the stacking location, that receives each of the sheets from the conveyor and that overlays each of the sheets in a stack extending downstream, the sheets being oriented in a second orientation in the stack.

49. An apparatus for stacking and separating sheets comprising:

a conveyor that transports sheets from a source in a first orientation in a stream aligned in a downstream direction to a stacking location;

a kicker located along the conveyor that offsets predetermined sheets in a direction substantially transverse to the downstream direction, the kicker including a gripping surface that engages predetermined sheets when the predetermined sheets are positioned relative to the kicker, the gripping surface imparting a force to the predetermined sheets in the substantially transverse direction to offset the sheets in the substantially transverse direction;

a weighted roller located to engage a downstream edge of each of the predetermined sheets when each of the predetermined sheets is located adjacent the kicker, the weighted roller constructed and arranged to enable movement of the sheets in the downstream direction and in the substantially transverse direction; and a stacker, positioned at the stacking location, that receives each of the sheets from the conveyor and that overlays each of the sheets in a stack extending downstream, the sheets being oriented in a second orientation in the stack.

50. An apparatus for stacking and separating sheets comprising:

a conveyor that transports sheets from a source in a first orientation in a stream aligned in a downstream direction to a stacking location, the conveyor including a table that supports the sheets thereon;

a kicker located along the conveyor at a position over each of the sheets and the table that offsets predetermined sheets in a direction substantially transverse to the downstream direction, the kicker including a gripping surface that moves from a position remote from the sheets and that frictionally engages the predetermined sheets to translate the predetermined sheets into an offset position, the gripping surface being positioned on the sheets so that sheet frictional resistance to offset translation upstream of the gripping surface substantially equals sheet frictional resistance to offset translation downstream of the gripping surface whereby each of the predetermined sheets translates relative to the table along the substantially transverse direction with upstream and downstream edges of the predetermined sheets remaining substantially parallel to the substantially transverse direction;

a spring that biases the gripping surface against the table to generate friction between the gripping surface and the predetermined sheets; and a stacker, positioned at the stacking location, that receives each of the sheets from the conveyor and that overlays each of the sheets in a stack extending downstream, the sheets being oriented in a second orientation in the stack.

51. An apparatus for stacking and separating sheets comprising:

a conveyor that transports sheets from a source in a first orientation in a stream aligned in a downstream direction to a stacking location;

a kicker located along the conveyor that offsets predetermined sheets in a direction substantially transverse to the downstream direction, the kicker including a gripping surface that engages the predetermined sheets to offset the predetermined sheets in the substantially transverse direction, the predetermined sheets being offset so that the upstream and downstream edges of the predetermined sheets remain substantially parallel to the substantially transverse direction;

a movable weighted roller constructed and arranged to engage a downstream edge of each of the sheets when each of the sheets is positioned adjacent the kicker, and the roller being movable to enable movement of the sheets in the substantially transverse direction and the downstream direction; and a stacker, positioned at the stacking location, that receives each of the sheets from the conveyor and that overlays each of the sheets in a stack, the sheets being oriented in a second orientation in the stack.

52. A method of stacking and separating sheets comprising the steps of:

providing a plurality of sheets from a source;

conveying each of the sheets in a downstream direction in a first orientation to a stacking location;

locating each of the sheets at an offset station and gripping predetermined sheets with a reciprocating gripping surface that engages and withdraws from the predetermined sheets and that translates each of the predetermined sheets in a direction substantially transverse to the downstream direction;

retaining a downstream edge of each of the predetermined sheets with a movable surface that maintains a downward pressure on each of the sheets when each of the sheets is located adjacent the offset station and that enables movement of each of the sheets in each of the downstream direction and the transverse direction; and forming each of the sheets at the stacking location into a stack with each of the sheets oriented in a second orientation.

53. An apparatus for stacking and separating sheets comprising:

a conveyor that transports sheets from a source in a first orientation in a stream aligned in a downstream direction to a stacking location;

a kicker located along the conveyor that offsets predetermined sheets in a direction substantially transverse to the downstream direction;

a stacker, positioned at the stacking location, downstream of the conveyor, that receives the sheets from the conveyor and that forms the sheets into a stack, the sheets being oriented in a second orientation in the stack, the stacker including a conveyor surface that drives sheets from the conveyor into the stack, the stacker further including a rotating eccentric cam that biases a downstream portion of the stack away from the conveying surface as additional sheets are driven into the stack.

* * * * *